US007834897B2

(12) United States Patent
Toyama et al.

(10) Patent No.: US 7,834,897 B2
(45) Date of Patent: Nov. 16, 2010

(54) OPTICAL SCANNING APPARATUS, CONTROL METHOD OF SUCH APPARATUS, AND IMAGE FORMING APPARATUS

(75) Inventors: Hiroshi Toyama, Suwa (JP); Yujiro Nomura, Shiojiri (JP); Ken Ikuma, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 954 days.

(21) Appl. No.: 11/670,843

(22) Filed: Feb. 2, 2007

(65) Prior Publication Data

US 2007/0188592 A1 Aug. 16, 2007

(30) Foreign Application Priority Data

Feb. 15, 2006 (JP) ..... 2006-038331
Oct. 13, 2006 (JP) ..... 2006-279409

(51) Int. Cl.
*B41J 2/47* (2006.01)

(52) U.S. Cl. ..... 347/132; 347/247

(58) Field of Classification Search ..... 347/132, 347/133, 134, 237, 247
See application file for complete search history.

(56) References Cited

U.S. PATENT DOCUMENTS 4,757,191 A * 7/1988 Shimada et al. ..... 250/205
4,990,763 A * 2/1991 Shinada ..... 250/205
5,642,439 A 6/1997 Sato et al.

FOREIGN PATENT DOCUMENTS

JP 06291994 A 10/1994
JP 08111749 A 4/1996
JP 2002-182147 6/2002

* cited by examiner

*Primary Examiner*—Huan H Tran
(74) *Attorney, Agent, or Firm*—Hogan Lovells US LLP

(57) ABSTRACT

An optical scanning apparatus in which an exposing signal is generated from pattern data indicating a position to be exposed by a light beam on a surface-to-be-scanned. A corrected exposing signal is generated by varying the width of pulses of the exposing signal in accordance with a distance between an exposing area corresponding to the pulse and an optical axis of the scanning optical system. The light beam is emitted and modulated by the corrected exposing signal. The pulse width and/or the light quantity of the light beam is/are varied in accordance with the distance between the exposing area and the optical axis of the scanning optical system.

13 Claims, 34 Drawing Sheets

FIG. 6A
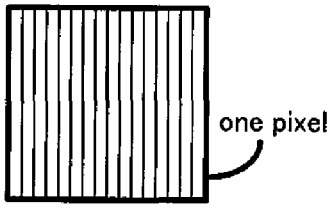
FIG. 6B
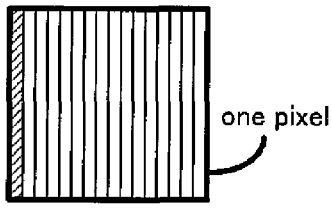
FIG. 6C
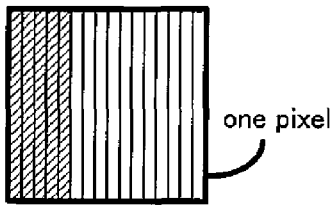
FIG. 6D
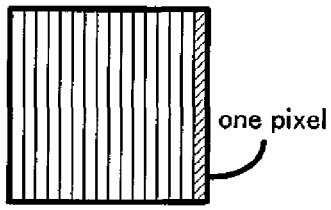
FIG. 6E
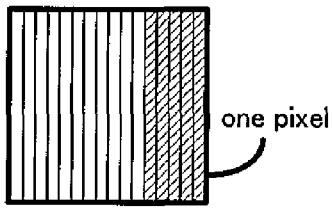
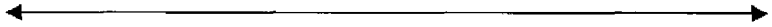
second direction (−X) main scanning direction X first direction (+X)

spot in the central part spot in the end part

FIG. 31

| | | | |
|---|---|---|---|
| N | J | F | O |
| E | A | B | K |
| I | D | C | G |
| M | H | L | P |

FIG. 32

<MTX>

| threshold value | | |
|---|---|---|
| A | 0 TO 15 : RIGHT-ALIGNING | 16 TO 255 : 1 PIXEL |
| B | 16 TO 31 : LEFT-ALIGNING | 32 TO 255 : 1 PIXEL |
| C | 32 TO 47 : LFFT-ALIGNING | 48 TO 255 : 1 PIXEL |
| D | 48 TO 63 : RIGHT-ALIGNING | 64 TO 255 : 1 PIXEL |
| E | 64 TO 79 : RIGHT-ALIGNING | 80 TO 255 : 1 PIXEL |
| F | 80 TO 95 : LEFT-ALIGNING | 96 TO 255 : 1 PIXEL |
| G | 96-111 : LEFT-ALIGNING | 112 TO 255 : 1 PIXEL |
| H | 112 TO 127 : RIGHT-ALIGNING | 128 TO 255 : 1 PIXEL |
| I | 128 TO 143 : RIGHT-ALIGNING | 144 TO 255 : 1 PIXEL |
| J | 144 TO 159 : RIGHT-ALIGNING | 160 TO 255 : 1 PIXEL |
| K | 160 TO 175 : LEFT-ALIGNING | 176 TO 255 : 1 PIXEL |
| L | 176 TO 191 : LEFT-ALIGNING | 192 TO 255 : 1 PIXEL |
| M | 192 TO 207 : RIGHT-ALIGNING | 208 TO 255 : 1 PIXEL |
| N | 208 TO 223 : RIGHT-ALIGNING | 224 TO 255 : 1 PIXEL |
| O | 224 TO 239 : LEFT-ALIGNING | 240 TO 255 : 1 PIXEL |
| P | 240 TO 255 : LEFT-ALINGING | |

OPTICAL SCANNING APPARATUS, CONTROL METHOD OF SUCH APPARATUS, AND IMAGE FORMING APPARATUS

CROSS REFERENCE TO RELATED APPLICATION

The disclosure of Japanese Patent Applications No. 2006-38331 filed Feb. 15, 2006 and No. 2006-279409 filed Oct. 13, 2006 including specification, drawings and claims is incorporated herein by reference in its entirety.

BACKGROUND

1. Technical Field

The invention relates to an optical scanning apparatus which makes a light beam scan on a surface-to-be-scanned in a main scanning direction, a control method of such an optical scanning apparatus, and an image forming apparatus which executes image formation using such an optical scanning apparatus.

2. Related Art

In an optical scanning apparatus of this type, a light source and a deflector are provided, and the light beam emitted from the light source is deflected by the deflector, thereby scanning the surface-to-be-scanned with the deflected light beam in a main scanning direction. Further, like an optical scanning apparatus described in JP-A-2002-182147 for example, in order to achieve the size reduction and speed-up of the deflector, an apparatus has heretofore been proposed which employs an oscillating deflection mirror as the deflector. That is, the apparatus is structured that a deflection mirror supported by a torsion bar is sinusoidally oscillated and a light beam emitted from a light source is reflected by a surface of the deflection mirror, whereby the light beam scans a surface-to-be-scanned such as a surface of a latent image carrier in a main scanning direction.

Further, in the optical apparatus described in JP-A-2002-182147, in order to scan the surface-to-be-scanned at a constant speed with the light beam deflected by the deflection mirror which oscillates sinusoidally as described above, a scanning optical system which has an arcsine characteristics is used. That is, the larger the incident angle to the scanning optical system of the light beam deflected by the deflection mirror which oscillates sinusoidally becomes, the slower the angular velocity of the incident angle becomes. Therefore, in the case where an orthoscopic scanning optical system is used for instance, the longer the distance (image height) from the optical axis in the main scanning direction becomes, the slower the scanning speed of the light beam on the surface-to-be-scanned becomes. Consequently, in order to compensate the decrease of the scanning speed at a position the image height being large, a scanning optical system which has an arcsine characteristics is used in which the output angle of the light beam increases more rapidly compared to the increase of the incident angle.

SUMMARY

However, in the case where the surface-to-be-scanned such as the surface of the latent image carrier is exposed with the light beam deflected by the deflection mirror surface which oscillates sinusoidally via the scanning optical system which has an arcsine characteristics as in the optical scanning apparatus described above, the incident angle of the light beam relative to the surface-to-be-scanned is different depending upon a position in the main scanning direction. As a result, the peak value of the distribution of the light quantity of a spot which exposes the surface-to-be-scanned becomes maximum when the spot is in the vicinity of the optical axis of the scanning optical system, and decreases as the spot moves away from the optical axis. Meanwhile, a spot area formed on the surface-to-be-scanned by exposing the surface with the light beam is called simply a "spot" in this specification. Hence, there has occurred an optical scanning trouble in some cases that the peak value of the distribution of the light quantity of the light beam, which exposes the surface-to-be-scanned, becomes maximum in the vicinity of the optical axis of the scanning optical system, and decreases with distance from the optical axis.

An advantage of some aspects of the invention is to provide a technique which enables to prevent the occurrence of the optical scanning trouble and to perform good optical scanning in an optical scanning apparatus in which the light beam, deflected by the deflection mirror surface oscillating sinusoidally, is scanned with a scanning optical system which has an arcsine characteristics.

According to a first aspect of the invention, there is provided a method for controlling an optical scanning apparatus, comprising: generating an exposing signal from a pattern data for an optical scanning apparatus, which includes a light source that emits a light beam, a deflector that deflects the light beam emitted from the light source by means of a deflection mirror surface oscillating sinusoidally, and a scanning optical system that has an arcsine characteristics and that images the light beam deflected by the deflector on a surface-to-be-scanned in a spot, and which makes the imaged spot scan the surface-to-be-scanned in the main scanning direction while modulating the light beam emitted from the light source based upon the pattern data indicating a position on the surface-to-be-scanned the light beam exposes so that the light beam exposes a predetermined position on the surface-to-be-scanned, the exposing signal being a train of pulses arranged on a time axis in accordance with an arrangement in the main scanning direction of values, which the pattern data have, indicating exposure or non-exposure of the light beam, a pulse width of each pulse of the pulses being width of time corresponding to a length, indicated by the pattern data, in the main scanning direction of an exposing area of the light beam; correcting the exposing signal to generate a corrected exposing signal by varying pulse width of each pulse of the pulses which compose the exposing signal in accordance with a distance between the exposing area corresponding to the pulse and an optical axis of the scanning optical system; and emitting the light beam from the light source modulated by the corrected exposing signal, wherein the pulse width of each pulse/both of the pulse width of each pulse and light quantity of the light beam is/are varied in accordance with a distance between the exposing area and an optical axis of the scanning optical system.

According to a second aspect of the invention, there is provided an optical scanning apparatus, comprising: a light source that emits a light beam; a deflector that deflects the light beam emitted from the light source by means of a deflection mirror surface which oscillates sinusoidally; a scanning optical system that has an arcsine characteristics and that images the light beam deflected by the deflector on a surface-to-be-scanned in a spot; a controller that makes the imaged spot scan the surface-to-be-scanned in the main scanning direction while modulating the light beam emitted from the light source based upon a pattern data which indicate a position to which the light beam exposes on the surface-to-be-scanned, whereby the light beam exposes a predetermined position on the surface-to-be-scanned; an exposing signal generator that generates an exposing signal which is a train of pulses which are arranged on a time axis in accordance with an arrangement in the main scanning direction of a value which the pattern data have and which indicates exposure/non-exposure of the light beam, a pulse width of each pulse of the pulses being width of time corresponding to a length, indicated by the pattern data, in the main scanning direction of an exposing area of the light beam; an exposing signal corrector that corrects the exposing signal to generate a corrected exposing signal by varying each pulse width of the pulses which compose the exposing signal in accordance with a distance between the exposing area corresponding to the pulse and an optical axis of the scanning optical system; and a beam modulator that emits the light beam from the light source modulated by the corrected exposing signal, wherein the pulse width of each pulse/both of the pulse width of each pulse and light quantity of the light beam is/are varied in accordance with a distance between the exposing area and an optical axis of the scanning optical system.

According to a third aspect of the invention, there is provided an image forming apparatus, comprising: a latent image carrier; a light source that emits a light beam; a deflector that deflects the light beam emitted from the light source by means of a deflection mirror surface which oscillates sinusoidally; a scanning optical system that has an arcsine characteristics and that images the light beam deflected by the deflector on a surface of the latent image carrier in a spot; a controller that makes the imaged spot scan the surface of the latent image carrier in the main scanning direction while modulating the light beam emitted from the light source based upon a pattern data which indicate a position on the surface of the latent image carrier the light beam exposes, whereby the light beam exposes a predetermined position on the surface of the latent image carrier; an exposing signal generator that generates an exposing signal which is a train of pulses which are arranged on a time axis in accordance with an arrangement in the main scanning direction of a value which the pattern data have and which indicates exposure/non-exposure of the light beam, a pulse width of each pulse of the pulses being width of time corresponding to a length, indicated by the pattern data, in the main scanning direction of an exposing area of the light beam; an exposing signal corrector that corrects the exposing signal to generate a corrected exposing signal by varying each pulse width of the pulses which compose the exposing signal in accordance with a distance between the exposing area corresponding to the pulse and an optical axis of the scanning optical system; and a beam modulator that emits the light beam from the light source modulated by the corrected exposing signal, wherein the pulse width of each pulse/both of the pulse width of each pulse and light quantity of the light beam is/are varied in accordance with a distance between the exposing area and an optical axis of the scanning optical system.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

BRIEF DESCRIPTION OF THE DRAWINGS

FIG. 6A is a drawing showing division of a pixel into a plurality of portions.

FIG. 6B is a drawing showing a left-aligned exposure of 1/16 pixel.

FIG. 6C is a drawing showing a left-aligned exposure of 5/16 pixel.

FIG. 6D is a drawing showing a right-aligned exposure of 1/16 pixel.

FIG. 6E is a drawing showing a right-aligned exposure of 5/16 pixel.

FIG. 23A is a drawing which shows a distribution of the light quantity of a spot at a central part, whereas

FIGS. 31 and 32 are drawings which show a dither matrix used in a first example.

DESCRIPTION OF EXEMPLARY EMBODIMENTS

First Embodiment

Figure 1:
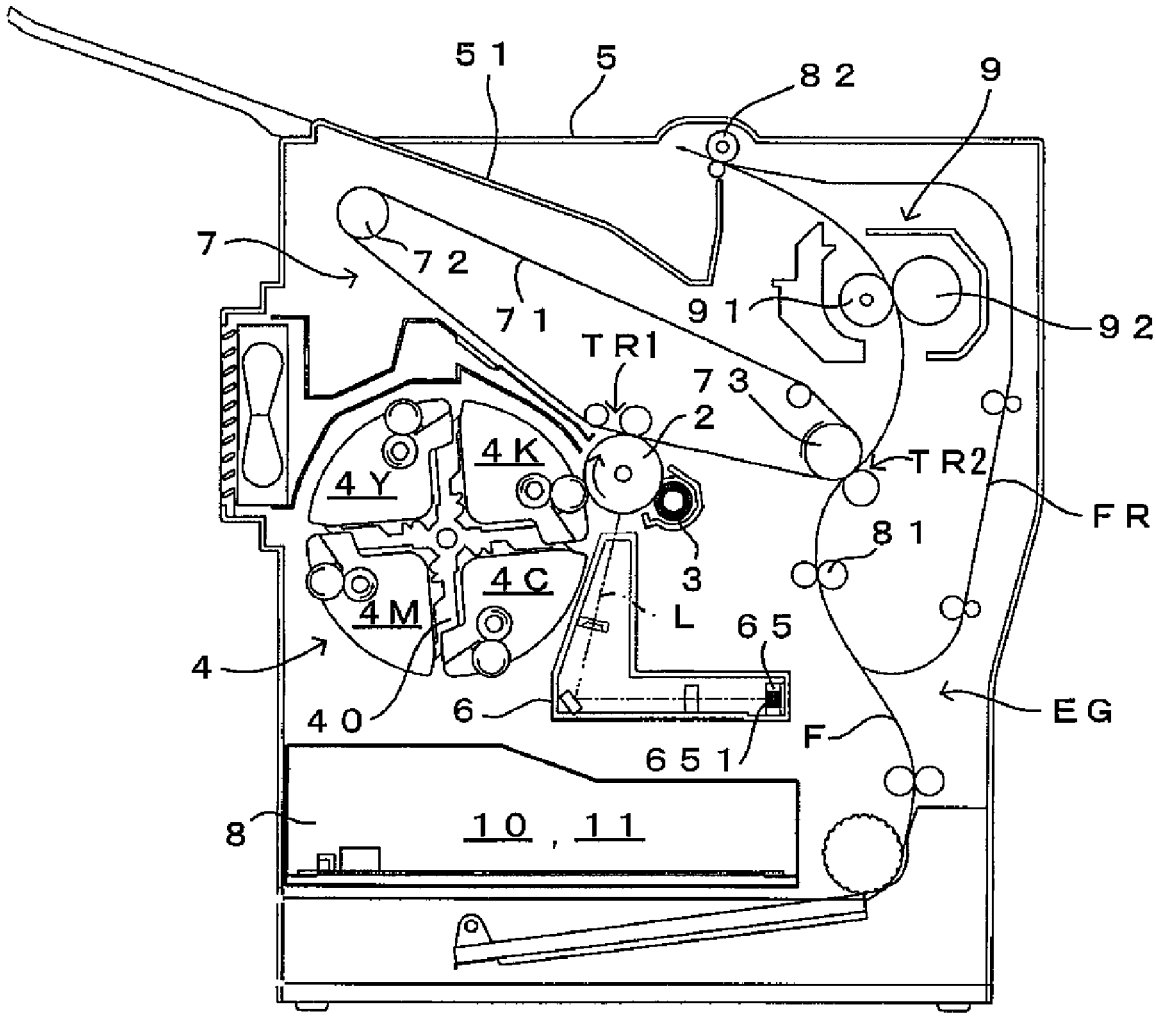
FIG. 1 is a drawing which shows a first embodiment of an image forming apparatus according to the invention.
Figure 2:
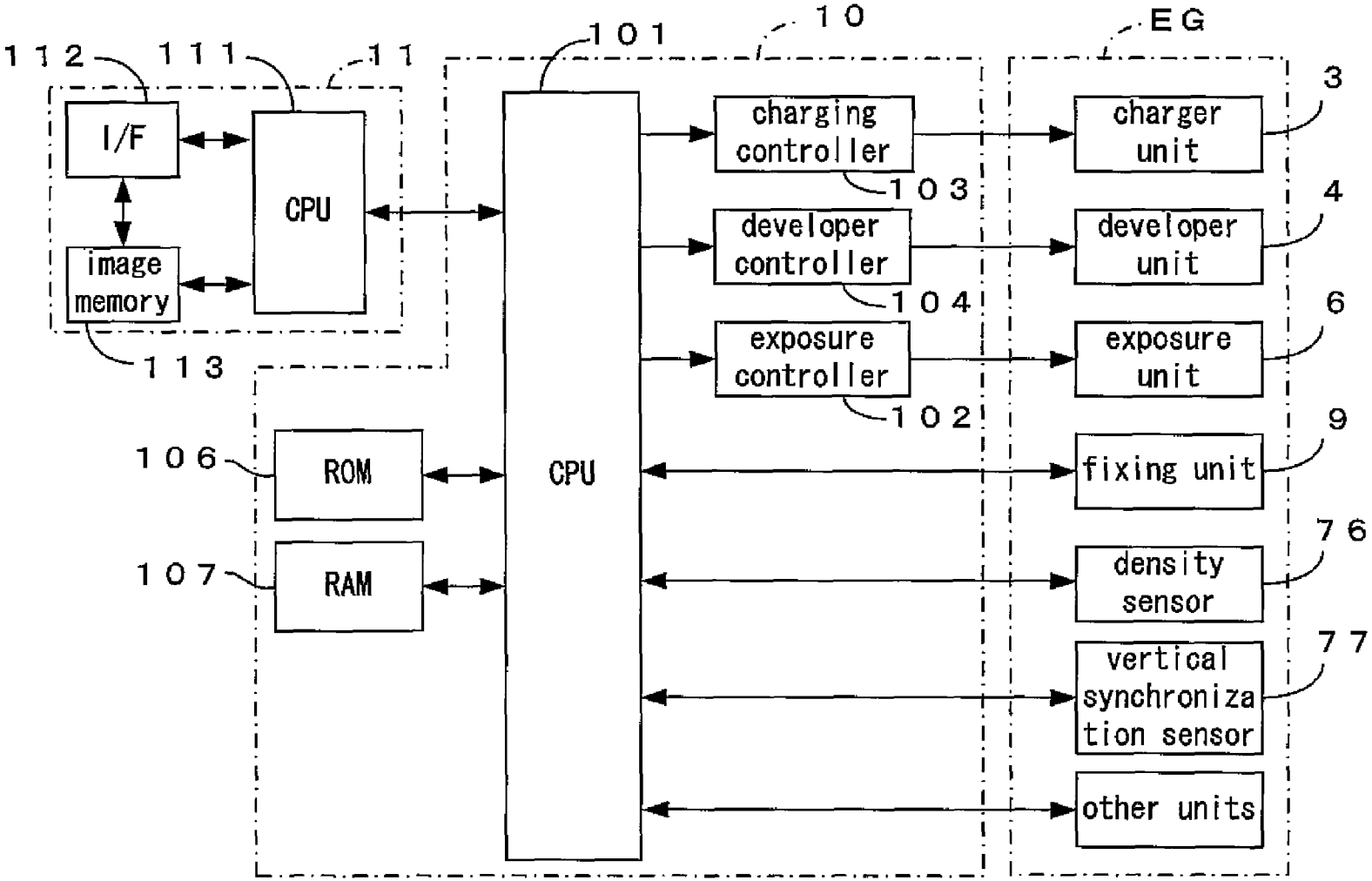
FIG. 2 is a block diagram which shows the electric structure of the image forming apparatus which is shown in FIG. 1.

FIG. 1 is a drawing which shows a first embodiment of an image forming apparatus according to the invention. FIG. 2 is a block diagram which shows the electric structure of the image forming apparatus which is shown in FIG. 1. This image forming apparatus is a laser printer LP-7000C manufactured by Seiko Epson Corporation in which the exposure unit is replaced by an exposure unit 6 which has the same structure as an optical scanning apparatus according to the invention, and is a color printer of the so-called 4-cycle type. In this image forming apparatus, when a print command is fed to a main controller 11 from an external apparatus such as a host computer in response to a user's image formation request, an engine controller 10 controls respective portions of an engine part EG in accordance with the print command received from a CPU 111 of the main controller 11, and an image which corresponds to the print command is formed on a sheet which may be a copy paper, a transfer paper, a general paper or a transparency for an overhead projector.

In the engine part EG, a photosensitive member 2 is disposed so that the photosensitive member 2 can freely rotate in an arrow direction (sub scanning direction) shown in FIG. 1. Further, around the photosensitive member 2 (latent image carrier), a charger unit 3 (charger), a rotary developer unit 4 (developer) and a cleaner (not shown) are disposed along the direction in which the photosensitive member 2 rotates. A charging controller 103 is electrically connected with the charger unit 3, for application of a predetermined charging bias upon the charger unit 3. The bias application uniformly charges an outer circumferential surface of the photosensitive member 2 to a predetermined surface potential. The photosensitive member 2, the charger unit 3 and the cleaner form one integrated photosensitive member cartridge which can be freely attached to and detached from an apparatus main body 5 as one integrated unit.

An exposure unit 6 (exposure section, optical scanning apparatus) emits a light beam L toward the outer circumferential surface (surface-to-be-scanned) of the photosensitive member 2 thus charged by the charger unit 3. The exposure unit 6 exposes the surface of the photosensitive member 2 with the light beam L which is in accordance with image data given from an external apparatus, whereby an electrostatic latent image corresponding to the image data is formed. The structure and operation of the exposure unit 6 will be described in detail later.

The developer unit 4 develops thus formed electrostatic latent image with toner. In this embodiment, the developer unit 4 comprises a support frame 40 which is axially disposed for free rotations, and also a yellow developer 4Y, a magenta developer 4M, a cyan developer 4C and a black developer 4K which house toner of the respective colors and are formed as cartridges which are freely attachable to and detachable from the support frame 40. As the developer unit 4 is driven into rotations in response to a control command given from a developer controller 104 of the engine controller 10 and the developers 4Y, 4C, 4M and 4K are selectively positioned at a predetermined developing position which abuts on the photosensitive member 2 or is faced with the photosensitive member 2 over a predetermined gap, toner of the color corresponding to the selected developer is supplied onto the surface of the photosensitive member 2 by a developer roller 44 which carries the toner of the selected color. In consequence, the electrostatic latent image on the photosensitive member 2 is visualized in the selected toner color.

A toner image developed by the developer unit 4 in the manner above is primarily transferred onto an intermediate transfer belt 71 of a transfer unit 7 in a primary transfer region TR1. The transfer unit 7 comprises the intermediate transfer belt 71 which runs across a plurality of rollers 72, 73, etc., and a driver (not shown) which drives the roller 73 into rotations to thereby revolve the intermediate transfer belt 71 in a predetermined revolving direction.

Further, there are a transfer belt cleaner (not shown), a density sensor 76 (FIG. 2) and a vertical synchronization sensor 77 (FIG. 2) in the vicinity of the roller 72. Of these, the density sensor 76 is disposed facing a surface of the intermediate transfer belt 71 and measures an image density of a patch image formed on an outer circumferential surface of the intermediate transfer belt 71. Meanwhile, the vertical synchronization sensor 77 is a sensor which detects a reference position of the intermediate transfer belt 71, and serves as a vertical synchronization sensor for obtaining a synchronizing signal which is output in relation to revolution of the intermediate transfer belt 71 in the sub scanning direction, namely, a vertical synchronizing signal Vsync. In this apparatus, for the purpose of aligning the timing at which the respective portions operate and accurately overlaying toner images of the respective colors on top of each other, the operation of the respective portions of the apparatus is controlled based on the vertical synchronizing signal Vsync.

For transfer of a color image onto a sheet, the toner images of the respective colors formed on the photosensitive member 2 are overlaid each other on the intermediate transfer belt 71, thereby forming a color image which will then be secondarily transferred onto a sheet taken out one by one from a cassette 8 and transported along a transportation path F to a secondary transfer region TR2.

At this stage, in order to properly transfer the images carried by the intermediate transfer belt 71 onto a sheet at a predetermined position, the timing of feeding the sheet to the secondary transfer region TR2 is controlled. To be specific, there is a gate roller 81 disposed in front of the secondary transfer region TR2 on the transportation path F, and as the gate roller 81 rotates in synchronization to the timing of revolution of the intermediate transfer belt 71, the sheet is fed into the secondary transfer region TR2 at predetermined timing.

Further, the sheet now bearing the color image is transported to a discharge tray part 51, which is disposed to a top surface portion of the apparatus main body 5, through a fixing unit 9 and a discharge roller 82. When images are to be formed on the both surfaces of a sheet, the discharge roller 82 moves the sheet bearing an image on its one surface in the manner above in a switch back motion. The sheet is therefore transported along a reverse transportation path FR. While the sheet is returned back to the transportation path F again before arriving at the gate roller 81, the surface of the sheet which abuts on the intermediate transfer belt 71 in the secondary transfer region TR2 and is to receive a transferred image is, at this stage, the opposite surface to the surface which already bears the image. In this fashion, it is possible to form images on the both surfaces of the sheet.

In FIG. 2, denoted at 113 is an image memory disposed in the main controller 11 for storage of image data fed from an external apparatus such as a host computer via an interface 112. Denoted at 106 is a ROM which stores a computation program executed by a CPU 101, control data for control of the engine part EG, etc. Denoted at 107 is a RAM which temporarily stores a computation result derived by the CPU 101, other data, etc.

Figure 3:
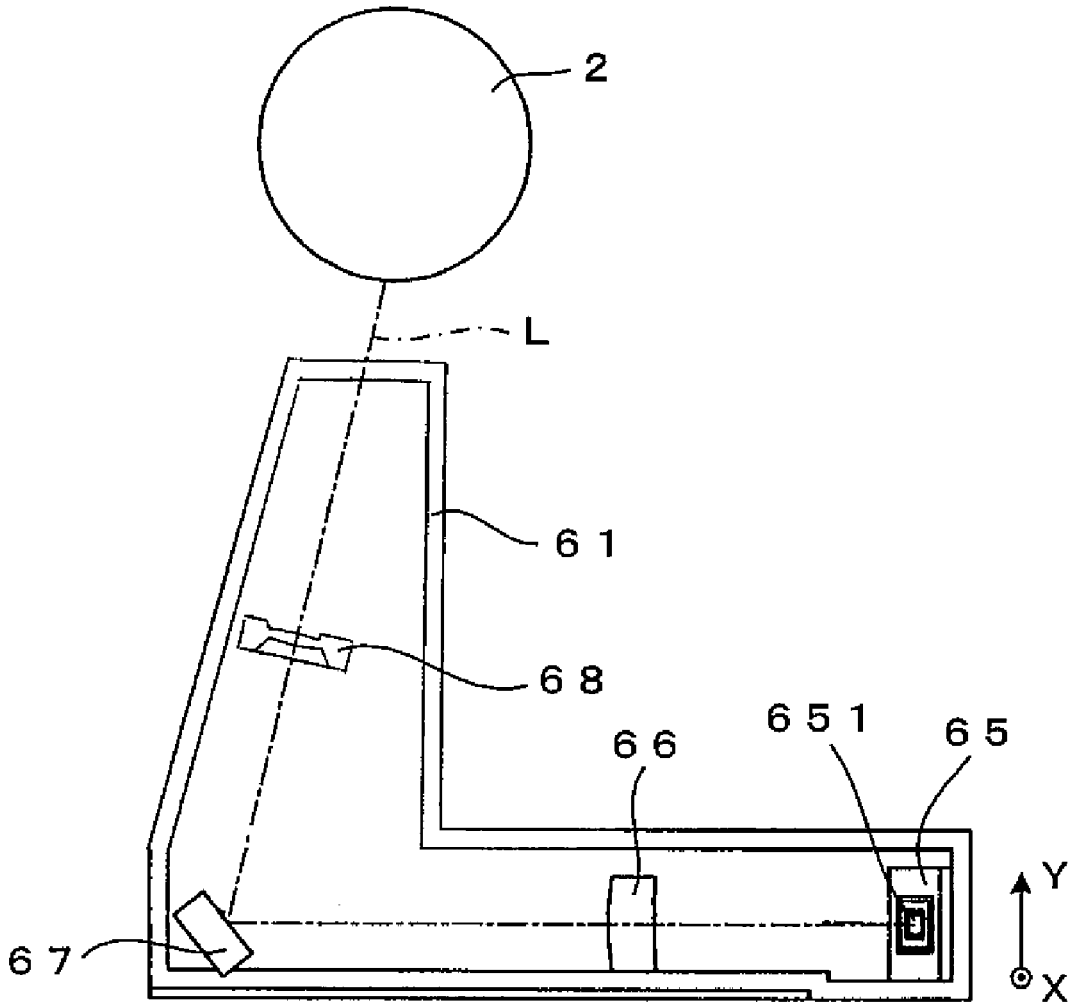
FIG. 3 is a sub-scanning cross sectional view showing the structure of the exposure unit which is disposed in the image forming apparatus shown in FIG. 1.
Figure 4:
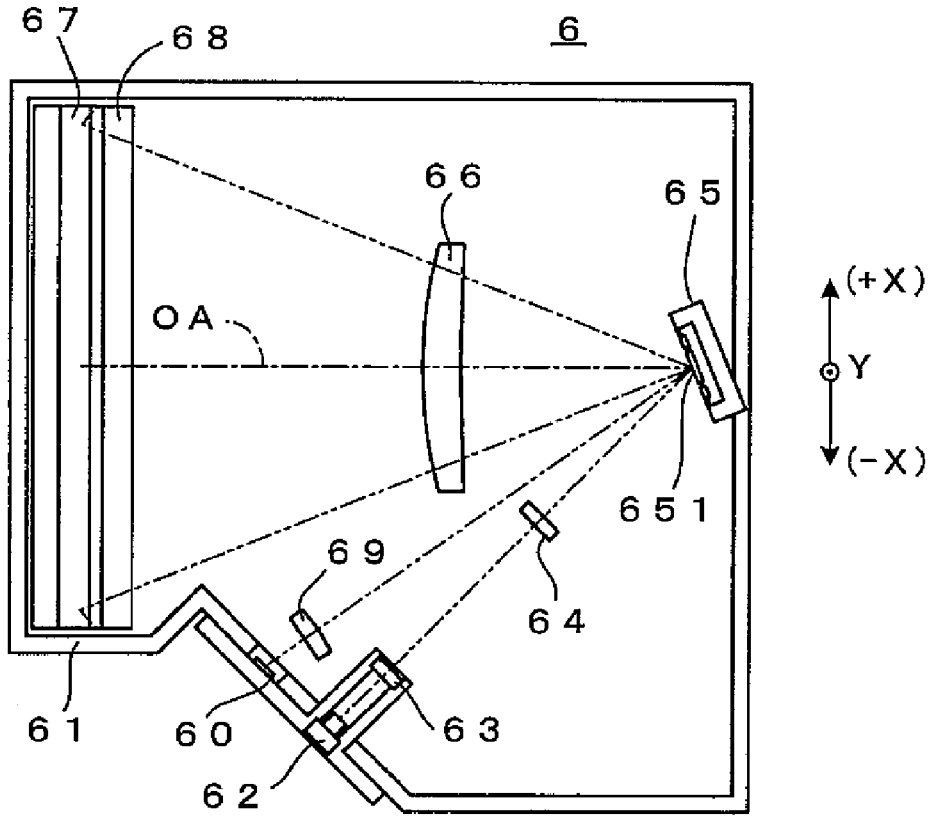
FIG. 4 is a main-scanning cross sectional view showing the structure of the exposure unit which is disposed in the image forming apparatus shown in FIG. 1.
Figure 5:
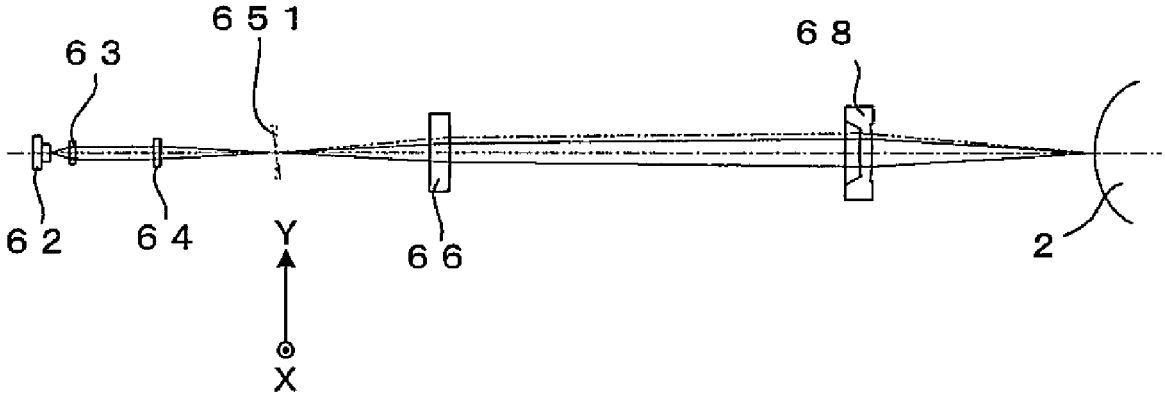
FIG. 5 is a sub-scanning cross sectional view showing the optical structure of the exposure unit.

FIG. 3 is a sub-scanning cross sectional view showing the structure of the exposure unit (optical scanning apparatus, exposure section) which is disposed in the image forming apparatus shown in FIG. 1. FIG. 4 is a main-scanning cross sectional view showing the structure of the exposure unit (optical scanning apparatus, exposure section) which is disposed in the image forming apparatus shown in FIG. 1. FIG. 5 is a sub-scanning cross sectional view showing the optical structure of the exposure unit (optical scanning apparatus, exposure section). The structure and operation of the exposure unit will now be described in detail with reference to these drawings.

The exposure unit 6 comprises an exposure housing 61. A single laser source (light source) 62 is fixed to the exposure housing 61, permitting emission of a light beam from the laser source 62. The laser source 62 is electrically connected with an exposure controller 102. A corrected video signal (corrected exposing signal) is given to the exposure controller 102 as described in detail hereinafter, the corrected video signal being obtained by correcting a pulse width of a video signal (exposing signal) generated based on the image data. Hence, the exposure controller 102 controls ON/OFF of the laser source 62, whereby a light beam which is modulated in accordance with the image data is emitted from the laser source 62. It is possible to control ON/OFF of the laser source 62 in a unit of 1/16 pixel. FIGS. 6A to 6E are drawings which show a control of ON/OFF of the laser source in a unit of 1/16 pixel. That is, in the first embodiment it is possible to expose the surface-to-be-scanned with the spot in a unit of 1/16 pixel, the unit being generated by dividing a pixel PX into 16 portions in the main scanning direction X as shown in FIG. 6A. Therefore, as shown in FIG. 6B, it is possible to perform a "LEFT-ALIGNING OF 1/16 PIXEL". In the "LEFT-ALIGNING OF 1/16 PIXEL", only the extreme left-handed portion among the 16 portions of the pixel PX or 1/16 pixel may be exposed with the spot, as shown in a shaded area in FIG. 6B. Whereas, as shown in FIG. 6C, it is possible to perform "LEFT-ALIGNING OF 5/16 PIXEL". In the "LEFT-ALIGNING OF 5/16 PIXEL", only five portions in a row from the extreme left-handed portion among the 16 portions of the pixel PX may be exposed with the spot, as shown in a shaded area in FIG. 6C. Further, on the other hand, as shown in FIG. 6D, it is possible to perform "RIGHT-ALIGNING OF 1/16 PIXEL". In the "RIGHT-ALIGNING OF 1/16 PIXEL", only the extreme right-handed portion among the 16 portions of the pixel PX or 1/16 pixel may be exposed with the spot, as shown in a shaded area in FIG. 6D. Whereas, as shown portions in FIG. 6E, it is possible to perform "RIGHT-ALIGNING OF 5/16 PIXEL". In the "RIGHT-ALIGNING OF 5/16 PIXEL", only five portions in a row from the extreme right-handed portion among the 16 portions of the pixel PX may be exposed with the spot, as shown in shaded portions in FIG. 6E. At this point, in the specification, "left" indicates a second direction (−X) in the main scanning direction X, and "right" indicates a first direction (+X) in the main scanning direction X. Further, in the specification, "LEFT-ALIGNING OF T/16 PIXEL", where T is an integer, shall indicate that T portions in a row from the extreme left-handed portion among the 16 portions of the pixel are exposed. Whereas, "RIGHT-ALIGNING OF T/16 PIXEL" shall indicate that T portions in a row from the extreme right-handed portion among the 16 portions of the pixel are exposed. Further, in the specification, in the case where referred to simply as "LEFT-ALIGNING", "LEFT-ALIGNING" shall mean that either of LEFT-ALIGNING OF 0/16 PIXEL to LEFT-ALIGNING OF 15/16 PIXEL is performed to the target pixel. Whereas, in the case where referred to simply as "RIGHT-ALIGNING", "RIGHT-ALIGNING" shall mean that either of RIGHT-ALIGNING OF 0/16 PIXEL to RIGHT-ALIGNING OF 15/16 PIXEL is performed to the target pixel.

To make the light beam from the laser source 62 scan and expose the surface of the photosensitive member 2, a collimator lens 63, a cylindrical lens 64, a deflector 65, a first scanning lens 66, a return mirror 67, and a second scanning lens 68 are disposed inside the exposure housing 61. To be more specific, after shaped into collimated light of a proper size by the collimator lens 63, the light beam from the laser source 62 impinges upon the cylindrical lens 64 which has power only in the sub scanning direction Y as shown in FIG. 5. Then, the collimated light, being focused only in the sub scanning direction Y, is imaged linearly in the vicinity of a deflection mirror surface 651 of the deflector 65.

The deflector 65 is made using a micro machining technique which is an application of semiconductor manufacturing techniques and which aims at forming an integrated micro machine on a semiconductor substrate, and is structured with a deflection mirror which resonates. That is, the deflector 65 is capable of deflecting a light beam by the resonating deflection mirror surface 651 in the main scanning direction X. To be more specific, the deflection mirror surface 651 is axially supported so that the deflection mirror surface 651 can freely oscillate about an oscillation axis (torsion spring) which is approximately orthogonal to the main scanning direction X, and the deflection mirror surface 651 oscillates sinusoidally about the oscillation axis in accordance with external force applied from an activator (not shown). Based on a mirror drive signal from a mirror driver (not shown) of the exposure controller 102, the activator exerts electrostatic, electromagnetic or mechanical external force upon the deflection mirror surface 651 and makes the deflection mirror surface 651 oscillate at the frequency of the mirror drive signal. The drive provided by the activator may be one which utilizes electrostatic absorption, electromagnetic force or mechanical force, each driving method of which is already known and will not be described here.

The light beam deflected by the deflection mirror surface 651 is guided to the outer circumferential surface (surface-to-be-scanned) of the photosensitive member 2 by a scanning optical system composed of the first scanning lens 66 and the second scanning lens 68. The scanning optical system has an arcsine characteristics, and the optical axis OA of the scanning optical system is indicated with a dashed-dotted line in FIG. 4. Further, the deflection mirror surface 651 oscillates sinusoidally about the oscillation axis as described above. Hence, the light beam scans the surface of the photosensitive member 2 at a constant speed in the main scanning direction X back and forth, that is, in the first direction (+X) or in the second direction (−X) which is opposite to the first direction (+X). And the light beam, thus scanning, exposes the surface (surface-to-be-scanned) of the photosensitive member (latent image carrier) 2 in a spot, the surface being charged uniformly in advance by the charger unit 3. Accordingly, the charge in the spot is removed, whereby a spot of latent image is formed. Meanwhile, a plurality of spots of latent image are formed in accordance with an image to be formed. Further, at the end of the scanning path of the scanning light beam in the upstream of the scanning direction (+X), the return mirror 69 guides the scanning light beam to a horizontal synchronization sensor 60. The horizontal synchronization sensor 60 detects the light beam scanning back and forth in the main scanning direction X every cycle and outputs a horizontal synchronizing signal Hsync. The latent image forming operation is controlled based upon the horizontal synchronizing signal Hsync.

The spots of latent image formed on the surface of the photosensitive member 2 in accordance with the image data of each color by the exposure unit 6 described above are developed with toner by the developers 4K, 4Y, 4M and 4C which house toner of colors corresponding to the image data respectively, whereby dots are formed (FIGS. 1 and 2). That is, in the case where the spots of latent image are formed on the surface of the photosensitive member 2 in accordance with the image data of black K for instance, the developer 4K which houses black toner develops the spots of latent image at a predetermined development position, whereby black dots are formed on the surface of the photosensitive member 2. In addition, dots of other colors (cyan C, magenta M and yellow Y) are also formed by developing the spots of latent image with toner using the developers 4C, 4M and 4Y which house toner of corresponding colors respectively, the spots of latent image having been formed in the same manner. Next, the signal processing executed in the image forming apparatus of the first embodiment will be described.

Figure 7:
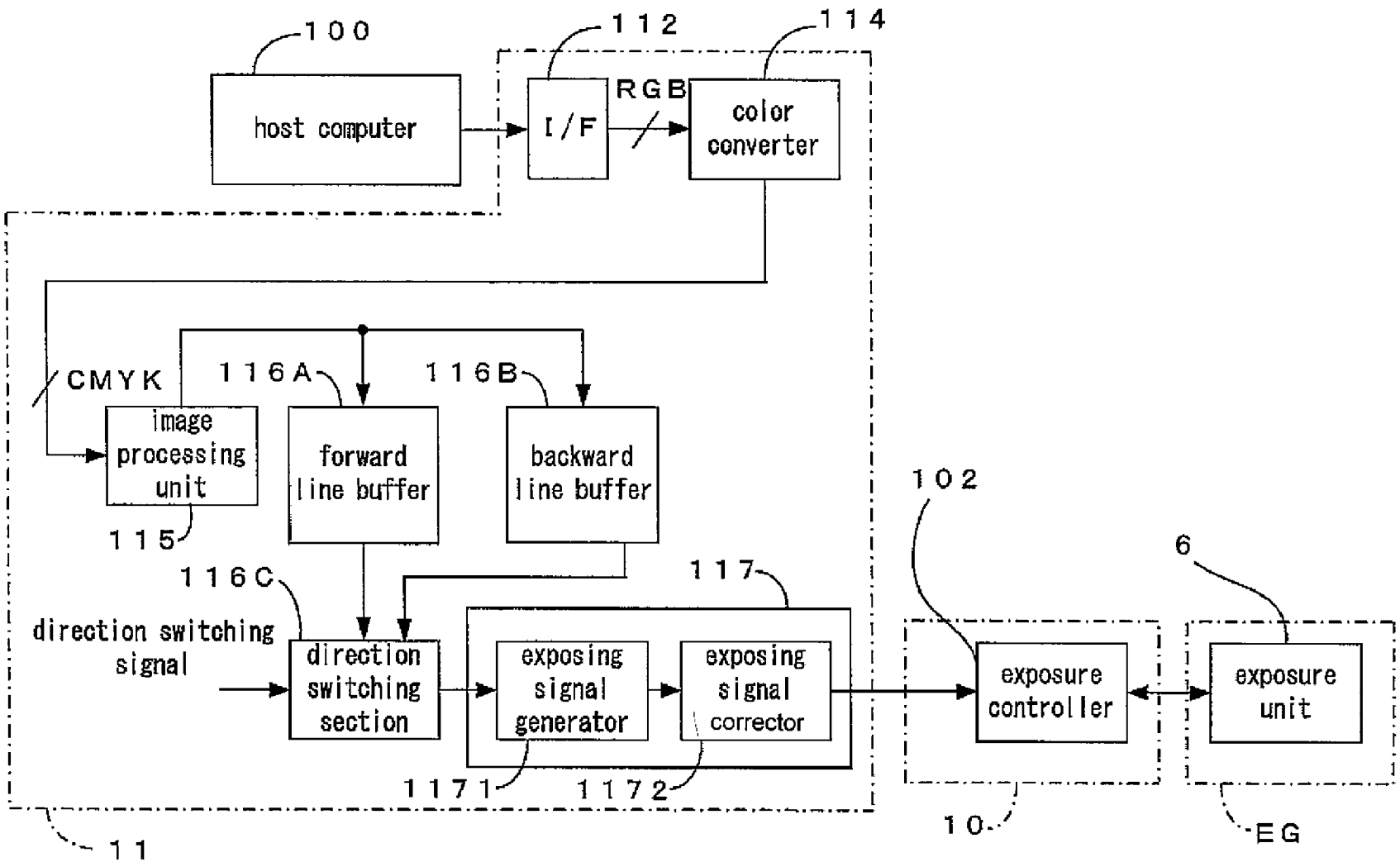
FIG. 7 is a block diagram showing an electric structure of the image forming apparatus of the first embodiment.
Figure 8:
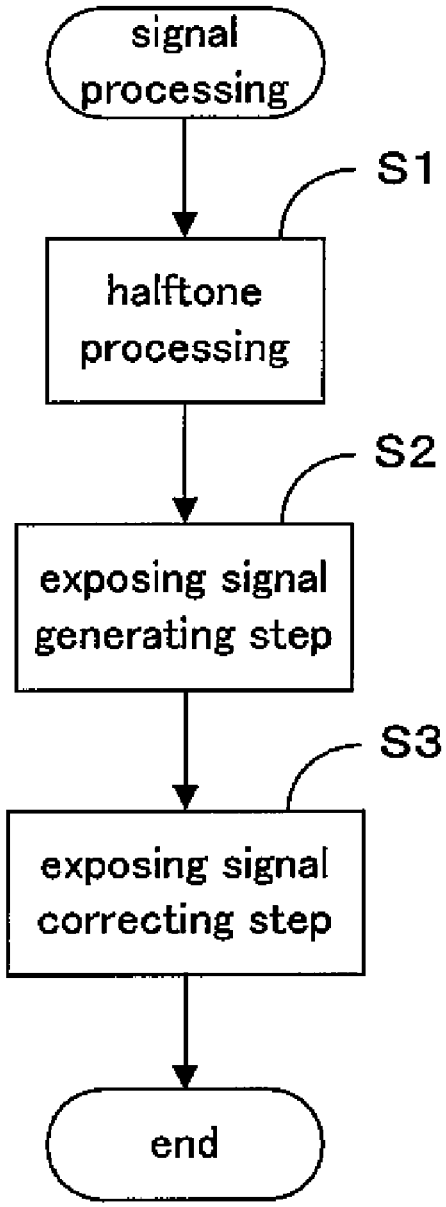
FIG. 8 is a flow chart showing the signal processing of the image forming apparatus of the first embodiment.
Figure 9:
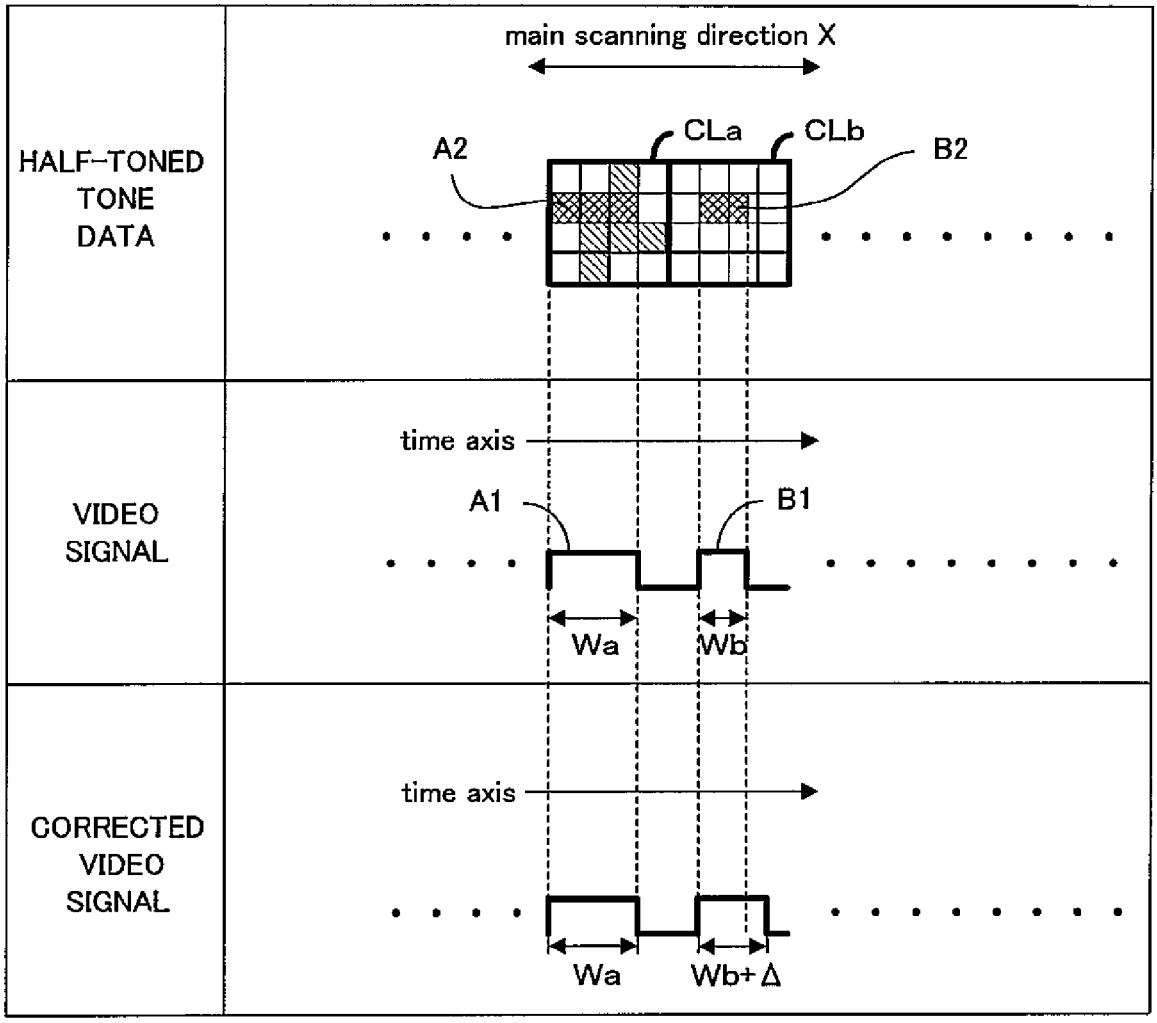
FIG. 9 is a drawing which shows an operation of the signal processing of the image forming apparatus of the first embodiment.

FIG. 7 is a block diagram showing an electric structure of the image forming apparatus of the first embodiment, and FIG. 8 is a flow chart showing the signal processing of the image forming apparatus of the first embodiment. Further, FIG. 9 is a drawing which shows an operation of the signal processing of the image forming apparatus of the first embodiment. When the image data from the external apparatus such as a host computer 100 is inputted to the image forming apparatus, the main controller 11 performs a predetermined signal processing on the image data. The main controller 11 includes function blocks such as a color converter 114, an image processing unit 115, two kinds of line buffers 116A and 116B, a direction switching section 116C, and a pulse modulating unit 117. These function blocks may be implemented in hardware or otherwise, in software executed by the CPUs 111 and 101.

In the main controller 11 supplied with the image data from the host computer 100, the color converter 114 converts RGB tone data into corresponding CMYK tone data (image tone data), the RGB tone data representing the respective tone levels of RGB components of each pixel in an image corresponding to the image data, the CMYK tone data representing the respective tone levels of CMYK components corresponding to the RGB components. In the color converter 114, the inputted RGB tone data comprise 8 bits per color component for each pixel (or representing 256 tone levels), whereas the outputted CMYK tone data similarly comprise 8 bits per color component for each pixel (or representing 256 tone levels). The CMYK tone data outputted from the color converter 114 are inputted to the image processing unit 115.

The image processing unit 115 performs a halftone processing to the inputted CMYK tone data (image tone data) (Step S1). In the halftone processing, CMYK tone data represented by 8 bits per color component for each pixel in multilevel are converted to a half-toned tone data (pattern data) which indicates a position for the light beam to expose in a spot in the surface (surface-to-be-scanned) of the photosensitive member (latent image carrier) 2.

As the halftone processing like this, various methods which have heretofore been proposed such as the Fattening-type dither method or the Bayer-type dither method may be used. Both of these methods reproduce tone by changing an area ratio of dots per unit area in a predetermined increasing pattern with an increase of tone level. To be more specific, dither matrix which defines such increasing pattern is provided, and cells composed of plural pixels adjoining each other are hypothetically arranged on the surface of the photosensitive member 2. Then, the CMYK tone data and the dither matrix are compared for each cell, and the half-toned tone data (pattern data) which indicate a position in the cell at which the light beam exposes are generated. Accordingly, the area ratio of dots formed in the cell is decreased when the tone level is low, whereas the area ratio of dots formed in the cell is increased when the tone value is high, whereby the tone reproduction is realized. In the first embodiment, the image processing unit 115 thus functions as a "halftone processor" of the invention. Meanwhile, in the first embodiment, the same dither matrix is used for all the cells to simplify the structure.

In the first embodiment, 4.times.4 cell, in which 4 pixels are arranged in the main scanning direction X and 4 pixels are arranged in the sub scanning direction approximately orthogonal to the main scanning direction X, is used. That is, 4.times.4 cell is composed of 4 by 4 pixels. And plural 4.times.4 cells are hypothetically arranged on the surface of the photosensitive member 2. Then, the halftone processing is performed using a dither matrix of 4 rows and 4 columns corresponding to the 4.times.4 cell, whereby the half-toned tone data (pattern data) are generated as shown in the upper column "HALF-TONED TONE DATA" in FIG. 9. At this point, in the upper column "HALF-TONED TONE DATA" in FIG. 9, each square of heavy line represented by the reference characters CLa and CLb indicates the 4.times.4 cell and each square of thin line indicates a pixel. Further, a shaded area indicates an area (exposing area) which is exposed by the light beam in a spot, whereas a non-shaded area indicates an area which is not exposed by the light beam or non-exposing area. Further, two areas (called simply "double-shaded areas" hereinafter), in which falling diagonal stroke from top left to bottom right and rising diagonal stroke from bottom left to top right are both drawn doubly, among the shaded areas in FIG. 9 are exposing areas especially corresponding to pulses A1 and B1 described later respectively.

The exposure controller 102 described above, receiving a corrected video signal (corrected exposing signal) from the pulse modulating unit 117, controls ON/OFF of the laser source 62 of the exposure unit 6. The pulse modulating unit 117 generates the corrected video signal using the half-toned tone data (pattern data) outputted from the image processing unit 115 for pulse width modulation of the light beam emitted from the laser source 62 in the engine part EG. On the other hand, scanning is performed with the light beam in the main scanning direction X back and forth by means of the resonating deflection mirror surface 651 in the first embodiment as described above. That is, scanning is performed with the light beam back and forth alternately, the respective scanning directions being opposite to each other. Therefore, it is necessary to change the order of inputting the half-toned tone data to the pulse modulating unit 117 depending upon the difference of the scanning direction of the light beam. Consequently, a forward line buffer 116A and a backward line buffer 116B are provided in the first embodiment.

Then, the half-toned tone data thus outputted are inputted to the direction switching section 116C, so that only the half-toned tone data outputted from either one of the line buffers, based on a direction switching signal, are outputted from the direction switching section 116C to the pulse modulating unit 117 in a proper timing. That is, when the scanning is performed with the light beam in the forward direction, a forward signal is given to the direction switching section 116C as the direction switching signal, whereby the half-toned tone data from the forward line buffer 116A are outputted toward the pulse modulating unit 117. On the other hand, when the scanning is performed with the light beam in the backward direction, a backward signal is given to the direction switching section 116C as the direction switching signal, whereby the half-toned tone data from the backward line buffer 116B are outputted toward the pulse modulating unit 117.

The pulse modulating unit 117 includes an exposing signal generator 1171 and an exposing signal corrector 1172. The half-toned tone data inputted to the pulse modulating unit 117 are converted to the video signal (exposing signal) in the exposing signal generator 1171 (exposing signal generating step, Step S2). An example of such conversion is shown in the middle column "VIDEO SIGNAL" in FIG. 9. In the middle column "VIDEO SIGNAL" in FIG. 9, a video signal is generated by converting the half-toned tone data which corresponds to pixels arranged in the main scanning direction of the second row from the top in the column "HALF-TONED TONE DATA" are shown. Thus, the video signal (exposing signal) is generated as a train of pulses which are arranged on the time axis in accordance with the arrangement of the values which the half-toned tone data have, the values indicating exposure/non-exposure of the light beam in the main scanning direction X. Then the pulses have time widths Wa and Wb corresponding to the length of the exposing area (double-shaded area) of the light beam in the main scanning direction X.

Next, the video signal generated in this way in the exposing signal generator 1171 is inputted to the exposing signal corrector 1172. The exposing signal corrector 1172 corrects, when needed, the pulse width of each pulse which composes the video signal, whereby the corrected video signal (corrected exposing signal) is generated (exposing signal correcting step, Step S3). In the exposing signal correcting step, it is determined first that whether the tone level of a cell to which the exposing area corresponding to each pulse of the video signal belongs is less than the tone level corresponding to the density of 50% or not. Meanwhile, the density of a cell which the light beam does not expose at all is defined as 0%, whereas the density of a cell of which the light beam exposes whole is defined as 100%. Hence, the density being 50% corresponds to a case where the light beam exposes half of the cell. Further, since the CMYK tone data are represented by 256 tone levels in the first embodiment as described above, the density of 50% corresponds to a tone level of 128, and the density of 100% corresponds to a tone level of 256.

At this point, a description is made with reference to FIG. 9. An exposing area corresponding to the pulse A1 of the video signal means the exposing area A2 represented by a double-shaded area. And a cell to which the exposing area A2 belongs means the cell CLa. And it is determined whether or not the tone level of the cell CLa is less than the tone level corresponding to the density of 50%. In the same way, an exposing area corresponding to the pulse B1 of the video signal means the exposing area B2 represented by a double-shaded area. And it is determined whether or not the tone level of the cell CLb is less than the tone level corresponding to the density of 50%. And the determination like this is performed for each pulse. When it is determined that the tone level of the cell is not less than the tone level corresponding to the density of 50%, the pulse width of a pulse corresponding to the cell is not changed, whereas when it is determined that the tone level of the cell is less than the tone level corresponding to the density of 50%, the pulse width of a pulse corresponding to the cell is changed (exposing signal correcting step, Step S3).

In the lower column "CORRECTED VIDEO SIGNAL" in FIG. 9, corrected video signals (corrected exposing signals) are shown which are generated through the determination described above for the pulses A1 and B1 of the video signals shown in the middle column in FIG. 9. First, as to the pulse A1, it is determined that the tone level of the corresponding cell CLa is not less than the tone level corresponding to the density of 50%, hence the pulse width Wa of the pulse A1 is not changed. On the other hand, as to the pulse B1, it is determined that the tone level of the corresponding cell CLb is less than the tone level corresponding to the density of 50%, hence the pulse width of the pulse B1 is changed from Wb to Wb+Δ. That is, as to the pulse B1, the pulse width is corrected so that it is longer by the correction amount Δ. And, in such correction, the correction amount Δ is determined based upon a following conversion pattern.

Figure 10:
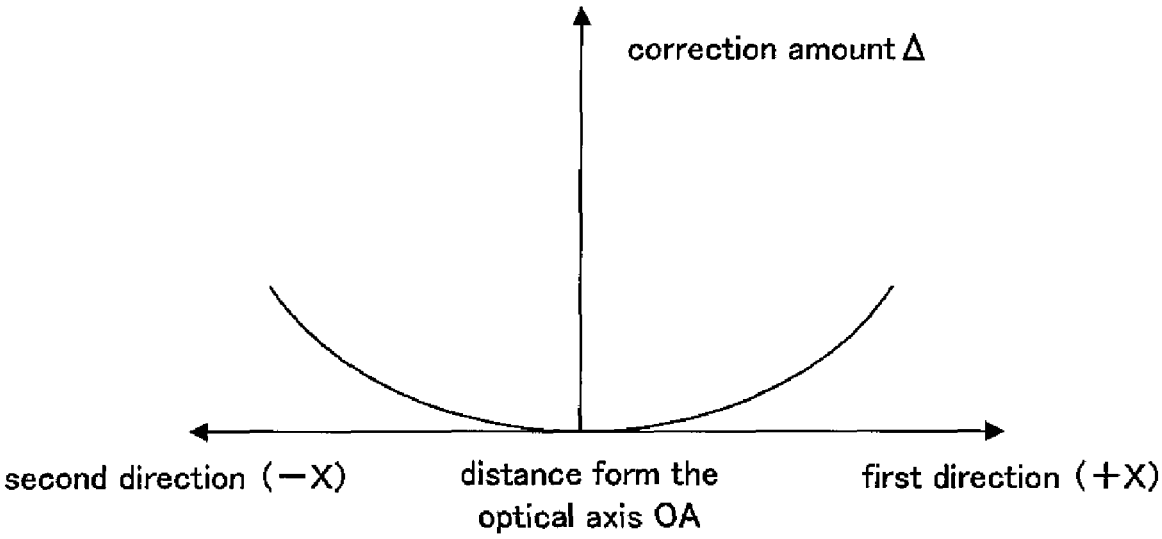
FIG. 10 is a drawing which shows a conversion pattern used in the first embodiment.

FIG. 10 is a drawing which shows a conversion pattern used in the first embodiment. In FIG. 10, the axis of abscissas represents a distance in the main scanning direction X between the position of a cell to which an exposing area corresponding to the pulse belongs and the optical axis OA of the scanning optical system composed of the first scanning lens 66 and the second scanning lens 68. The axis of ordinates represents the correction amount Δ. As shown in FIG. 10, the correction amount Δ increases as the distance in the main scanning direction X between the position of the cell and the optical axis OA of the scanning optical system increases in the first embodiment. And the corrected video signals (corrected exposing signals) generated in this way are outputted to the engine controller 10 via the video interface not shown. And the exposure controller 102 which is given the corrected video signal controls ON/OFF of the laser source 62 of the exposure unit (optical apparatus) 6, whereby the laser source 62 emits the modulated light beam (beam modulating step). Thus, in the first embodiment, the exposure controller 102 functions as a "beam modulator" of the invention.

In the image forming apparatus including the exposure unit (optical scanning apparatus) described above, a toner image is formed as follows. The image forming apparatus includes the photosensitive member (latent image carrier) 2 which is capable of forming a toner image on its surface, the rotary development unit (developer) 4 and the charger unit (charger) 3. In the image forming apparatus, the halftone processing is performed to the CMYK tone data (image tone data) which represents the tone level of each pixel in multilevel, whereby the half-toned tone data (pattern data) are generated which indicate the position to adhere toner on the surface of the photosensitive member (latent image carrier). That is, in the image forming apparatus like this, the adhesion area of toner per unit area is changed, whereby the tone reproduction is realized. To be more specific, in the case where the tone level is high, the adhesion area of toner per unit area is increased, whereas in the case where the tone level is low, the adhesion area of toner per unit area is decreased, whereby the tone reproduction is realized. So, in the image forming apparatus like this, the halftone processing is performed, whereby the image tone data which represent the tone level of each pixel in multilevel are converted to the half-toned tone data (pattern data) which indicate the position to adhere toner on the surface of the latent image carrier.

Then, the exposing signals are generated based upon the half-toned tone data (pattern data) and the exposing signals are outputted to the light source provided in the optical scanning apparatus. As a result, the light beam modulated based upon the exposing signal is emitted from the light source, and the modulated light beam is deflected in the main scanning direction by means of the oscillating deflection mirror surface.

The modulated light beam is deflected as described above, whereby a predetermined position on the surface of the photosensitive member (latent image carrier) which is charged uniformly in advance by the charger unit (charger) is exposed in a spot by the light beam, and the charge of the spot is removed and a spot-like electrostatic latent image (spot of latent image) is formed. Then, the developer adheres charged toner to the spot of latent image formed in this way, whereby a dot is formed at a predetermined position on the surface of the photosensitive member (latent image carrier). This leads to form a toner image on the surface of the photosensitive member (latent image carrier).

However, in the case where the surface-to-be-scanned such as the surface of the photosensitive member (latent image carrier) is exposed with the light beam deflected by the deflection mirror surface which oscillates sinusoidally via the scanning optical system which has an arcsine characteristics as in the exposure unit (optical scanning apparatus) described above, the incident angle of the light beam to the surface-to-be-scanned is different depending upon a position in the main scanning direction. As a result, there has occurred an optical scanning trouble in some cases that the peak value of the distribution of the light quantity of a spot which exposes the surface-to-be-scanned becomes maximum when the spot is in the vicinity of the optical axis of the scanning optical system, and decreases with distance from the optical axis in the main scanning direction. And such optical scanning trouble may lead to an adverse effect on an image described hereinafter. And the adverse effect could be especially prominent in the case where an image of low density (highlight image) is formed using the above-mentioned exposure unit (optical scanning apparatus).

In the case where an image is formed using the optical scanning apparatus, the exposure unit (optical scanning apparatus) exposes the surface (surface-to-be-scanned) of the photosensitive member in a spot and forms a spot of latent image, and then toner is adhered to the spot of latent image, whereby a dot is formed, as described above. Therefore, when the peak value of the distribution of the light quantity of a spot is different depending upon a position of the spot in the main scanning direction due to the optical scanning trouble described above, the distribution of the electric potential of the spot of latent image is also different, and the size of the dot formed by developing the spot of latent image with toner is also different depending upon a position of the spot in the main scanning direction. That is, in some cases, the size of a formed dot becomes maximum in the vicinity of the optical axis of the scanning optical system, and decreases as the dot moves away from the optical axis in the main scanning direction. As a result, in spite of trying to form images having same density each other, there may occur an adverse effect on an image that the image density decreases as the distance from the optical axis of the scanning optical system in the main scanning direction. And the adverse effect on an image becomes strongly apparent in the case where a highlight image of which the density is low is formed. Such challenge will be described in more detail.

As described above, in the image forming apparatus of the first embodiment, the exposure unit (optical scanning apparatus, exposing section) 6 is used. In the exposing unit (optical scanning apparatus, exposing section) 6, the light beam emitted from the laser source (light source) 62 is deflected by the deflection mirror surface 651 which oscillates sinusoidally, and the deflected light beam is guided to the surface of the photosensitive member 2 by the scanning optical system which has an arcsine characteristics and which is composed of the first scanning lens 66 and the second scanning lens 68 in the first embodiment, whereby the light beam scans and exposes the surface (surface-to-be-scanned) of the photosensitive member (latent image carrier) 2 in a spot in the main scanning direction X. In such case, the incident angle to the surface of the photosensitive member 2 is different depending upon the position in the main scanning direction. As a result, an optical scanning trouble may occur that the peak value of the distribution of the light quantity of a spot which exposes the surface-to-be-scanned such as the surface of the photosensitive member 2 is different depending upon a position in the main scanning direction.

Figure 11A:
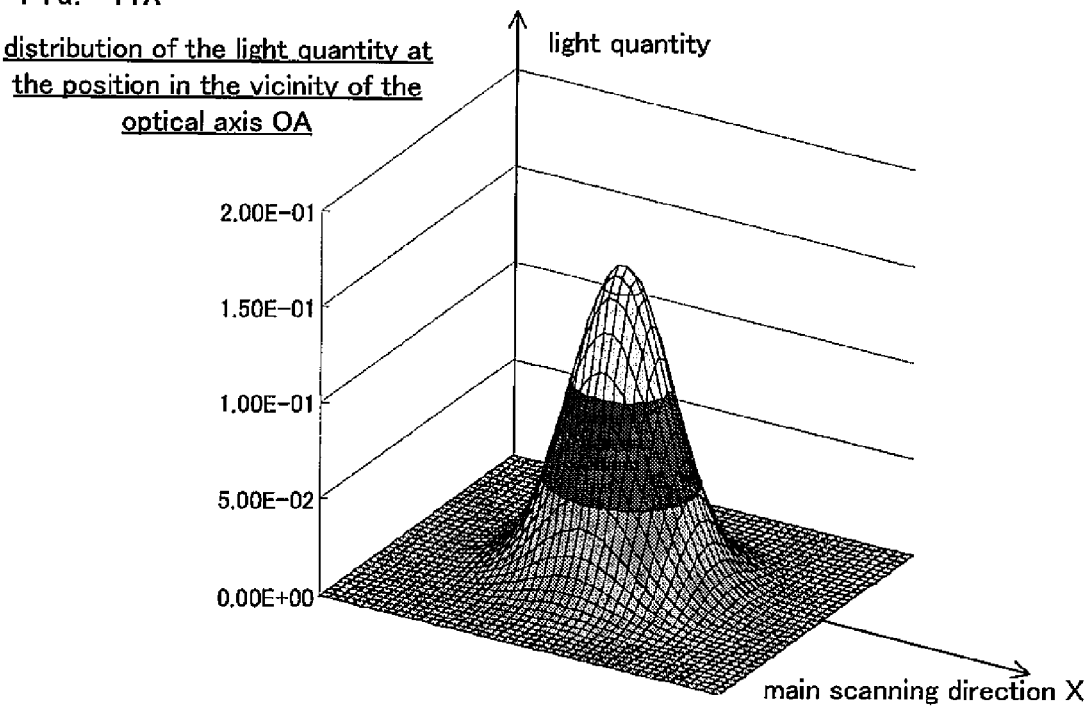
FIG. 11A is a drawing which shows the distribution of the light quantity of a spot which exposes the surface of the photosensitive member at a position in the vicinity of the optical axis.
Figure 11B:
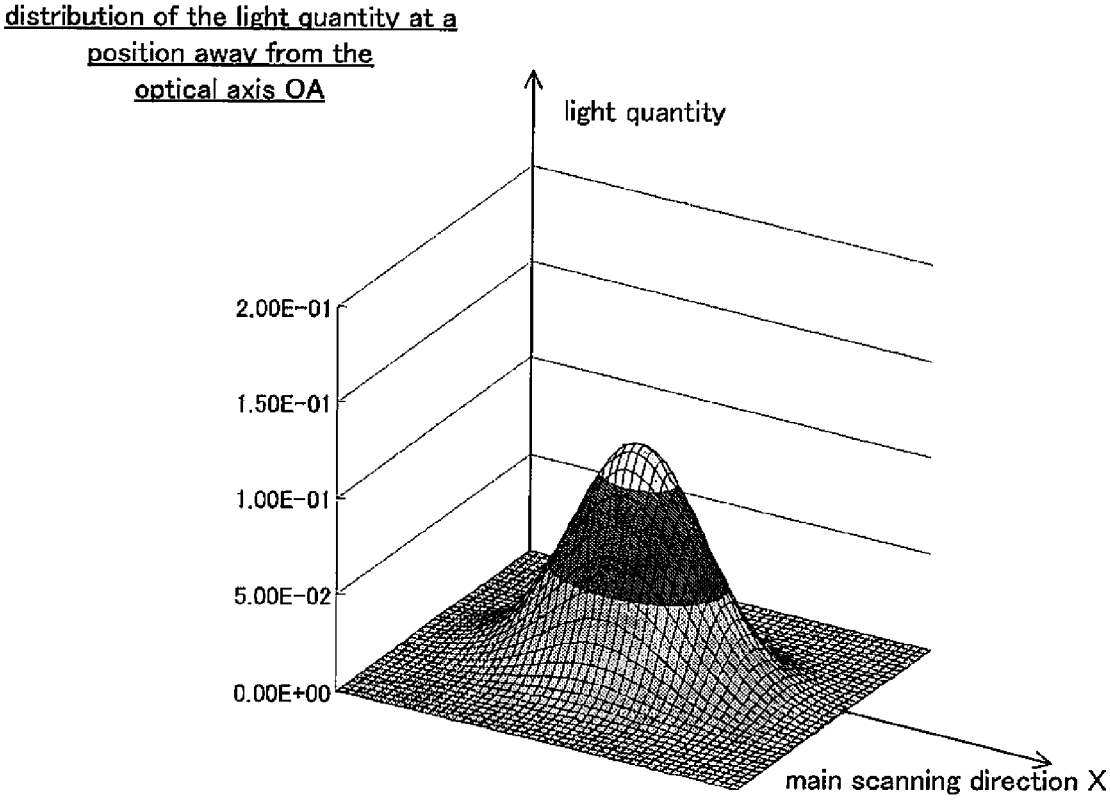
FIG. 11B is a drawing which shows the distribution of the light quantity of a spot which exposes the surface of the photosensitive member at a position away from the optical axis.

FIGS. 11A and 11B are drawings which show a difference of the distribution of the light quantity depending upon a position in the main scanning direction. To be more specific, FIG. 11A is a drawing which shows the distribution of the light quantity of a spot which exposes the surface of the photosensitive member 2 at a position in the vicinity of the optical axis OA, whereas FIG. 11B is a drawing which shows the distribution of the light quantity of a spot which exposes the surface of the photosensitive member 2 at a position away from the optical axis OA. As shown in FIGS. 11A and 11B, the distribution of the light quantity of a spot which exposes the surface of the photosensitive member 2 spreads wider in the main scanning direction X at a position away from the optical axis OA than at a position in the vicinity of the optical axis OA. As a result an optical scanning trouble may occur in which the peak value of the distribution of the light quantity of a spot is relatively high in the vicinity of the optical axis OA, whereas it is relatively low at a position away from the optical axis OA. And when an optical scanning operation to scan the surface of the photosensitive member 2 is executed in the state that the optical scanning trouble like this has occurred, the following electrostatic latent image is formed.

Figure 12:
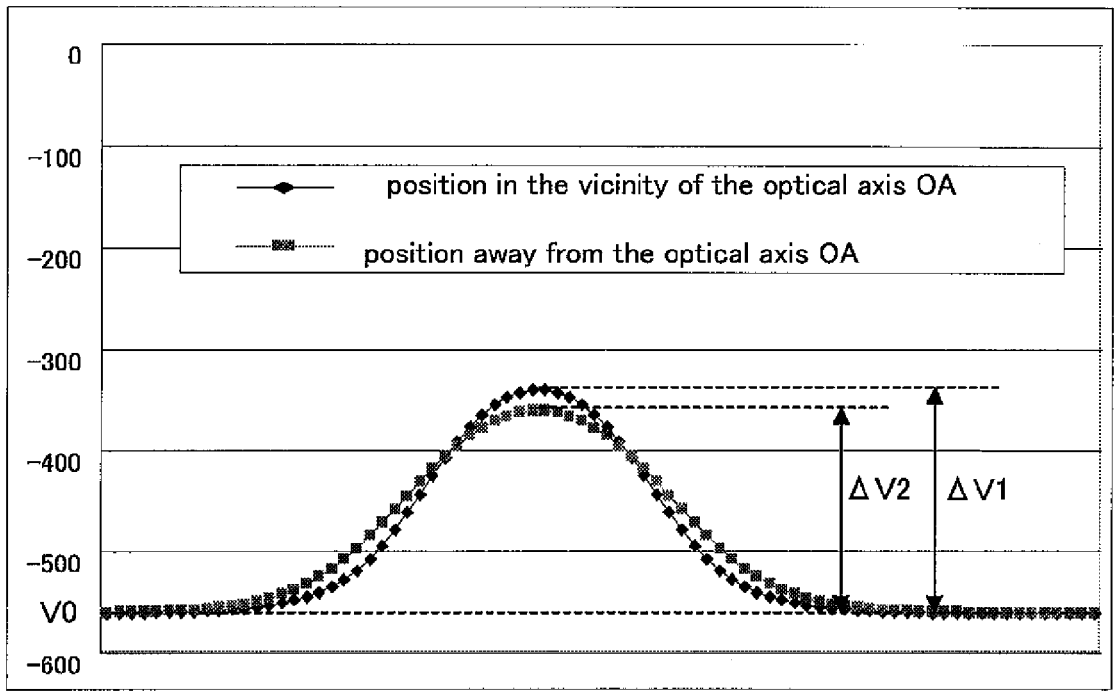
FIG. 12 is a drawing which shows the distribution of electric potentials of spots of latent image formed with spots which have the distribution of the light quantity shown in FIGS. 11A and 11B.

FIG. 12 is a drawing which shows the distribution of electric potentials of spots of latent image formed with spots which have the distribution of the light quantity shown in FIGS. 11A and 11B. To be more specific, FIG. 12 is a drawing which shows a comparison of the distribution of the electric potentials of spots of latent image which are formed by exposing the surface of the photosensitive member 2 with the spots at a position in the vicinity of the optical axis OA and at a position away from the optical axis OA after charging the surface of the photosensitive member 2 uniformly at a predetermined electric potential V0 by the charger unit 3. As can be understood from FIG. 12, the peak value ΔV2 of the spot of latent image at a position away from the optical axis OA is less than the peak value ΔV1 of the spot of latent image at a position in the vicinity of the optical axis OA. At this point, the "peak value" is defined as the absolute value of the difference between the peak of the electric potential and the predetermined electric potential V0. That is, FIG. 12 indicates that the peak value of the spot of latent image decreases with distance from the optical axis OA.

Figure 13A:
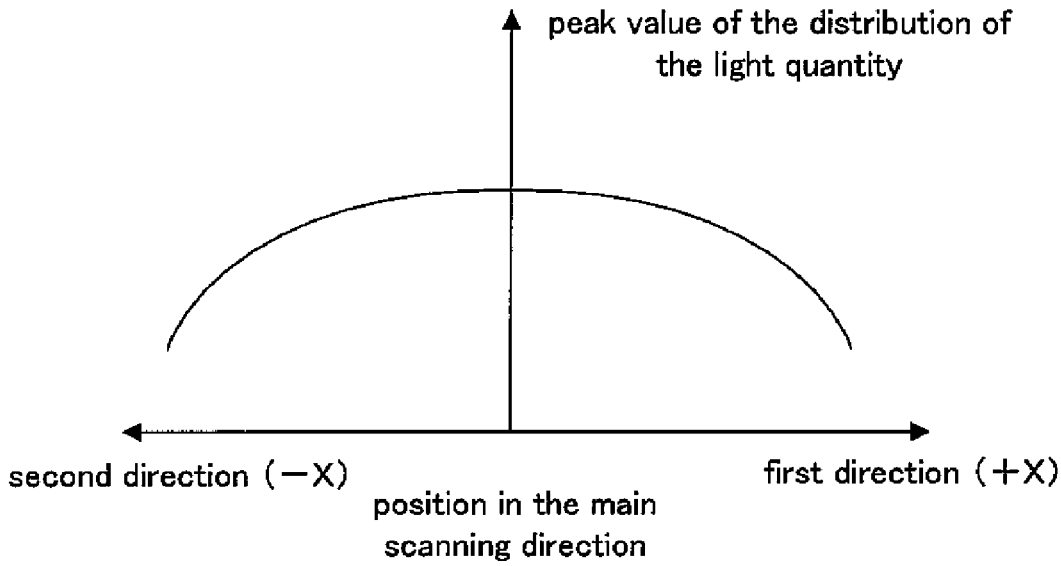
FIG. 13A is a drawing which schematically shows the peak value of a distribution of the light quantity.
Figure 13B:
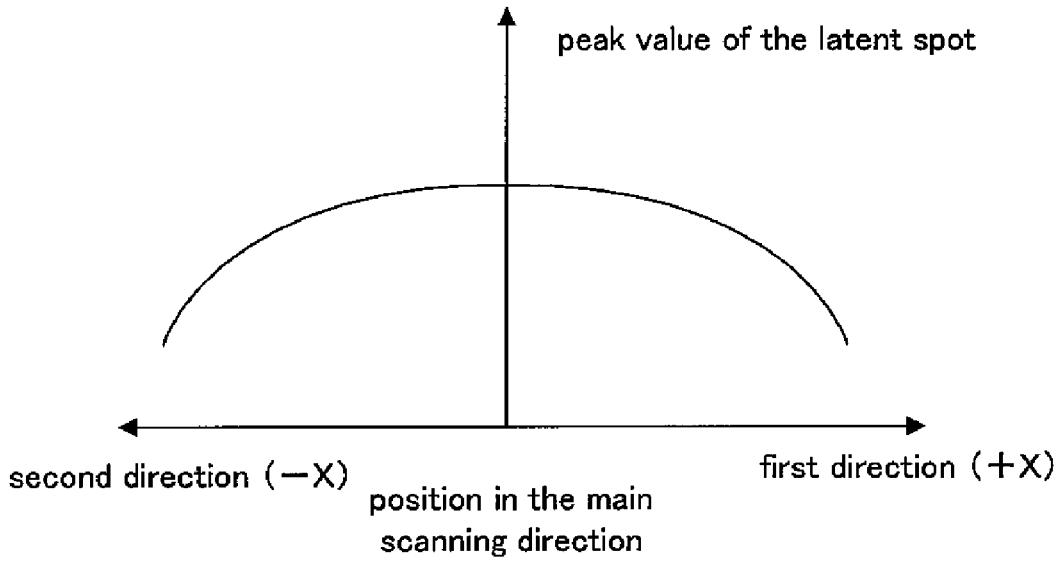
FIG. 13B is a drawing which schematically shows the peak value of a spot of latent image.

FIGS. 13A and 13B are drawings which schematically show the peak value of such distribution of the light quantity and the peak value of such spot of latent image respectively. In FIG. 13A, the axis of abscissas represents a position in the main scanning direction, the axis of ordinates represents the peak value of a spot, and the optical axis OA is positioned at the intersection of the axis of abscissas with the axis of ordinates. Further, in FIG. 13B, the axis of abscissas represents a position in the main scanning direction, the axis of ordinates represents the peak value of a spot of latent image, and the optical axis OA is positioned at the intersection of the axis of abscissas with the axis of ordinates. That is, as shown in FIG. 13A, in the image forming apparatus which includes the exposure unit (optical scanning apparatus, exposing section) 6 structured described above, the optical scanning trouble occurs in which the peak value of the distribution of the light quantity of the spot which exposes the surface of the photosensitive member 2 decreases continuously with distance from the optical axis OA. And as shown in FIG. 13B, the peak value of the spot of latent image formed by exposing the surface with a spot like this also decreases continuously with distance from the optical axis OA. As a result, the size of a dot obtained by developing the spot of latent image like this decreases with distance from the optical axis OA.

Incidentally, as described above, in the image forming apparatus according to the first embodiment, the area ratio of dots per unit area is changed, whereby the tone reproduction is realized. Hence, when the size of a dot decreases with distance from the optical axis OA like this, there occurs an adverse effect on an image that the image density decreases with distance from the optical axis OA. And the adverse effect on an image like this becomes strongly apparent in the case where a highlight image of which the density is low is formed.

On the other hand, in the invention, as shown in FIG. 9, in the case where the tone level of a cell to which a pulse, which composes a video signal (exposing signal), belongs is less than the tone level corresponding to the density of 50%, the pulse width is changed in accordance with the conversion pattern shown in FIG. 10. And the conversion pattern is structured that the correction amount Δ increases as the distance in the main scanning direction X between the optical axis OA of the scanning optical system and the cell increases. Hence, the corrected video signal (corrected exposing signal) is generated so that the pulse width of a pulse which belonging to a cell of which the tone level is less than that corresponding to the density of 50% increases as the distance in the main scanning direction X between the optical axis OA of the scanning optical system and the cell increases. Hence, the difference of the peak value of the distribution of the light quantity of a spot which exposes the surface (surface-to-be-scanned) of the photosensitive member (latent image carrier) 2 is reduced, the difference depending upon a position of the spot in the main scanning direction. And so, it becomes possible to execute the optical scanning operation favorably. And, the image formation is executed by means of the optical scanning apparatus which is able to execute such favorable optical scanning operation, whereby the difference of the image density described above depending upon the position in the main scanning direction is reduced, and the formation of the favorable highlight image is possible.

In the first embodiment, pulse width of the video signal (exposing signal), which is a train of pulses arranged on the time axis in accordance with the arrangement in the main scanning direction of the value which the half-toned tone data (pattern data) have, is corrected so as to generate the corrected exposing signal. As described above, the half-tone toned data indicates exposure/non-exposure of the light beam. A pulse width of each pulses, composing the video data, is width of time corresponding to the length, indicated by the half-toned tone data (pattern data), in the main scanning direction of the exposing area of the light beam.

In short, the video signal (exposing signal) is corrected as follows and the corrected exposing signal is generated. That is, the pulse width of each pulse which composes the video signal (exposing signal) is converted based upon a conversion pattern in the case where the tone level of a cell to which the exposing area corresponding to the pulse belongs is in the predetermined tone range, whereby the video signal (exposing signal) is corrected and the corrected video signal (corrected exposing signal) is generated. And, it is structured that the light beam modulated by the corrected video signal (corrected exposing signal) is emitted from the light source. At this point, the conversion pattern is a pattern which increases the pulse width as the distance in the main scanning direction between the position of the cell to which the exposing area corresponding to the pulse belongs and the optical axis of the scanning optical system increases. Hence, the difference of the peak value of the distribution of the light quantity of a spot which exposes the surface (surface-to-be-scanned) of the photosensitive member is reduced, the difference depending upon a position of the spot in the main scanning direction. And it becomes possible to execute the optical scanning operation favorably. And the image formation is executed by means of the optical scanning apparatus which is able to execute such favorable optical scanning operation, whereby the difference of the image density described above depending upon the position in the main scanning direction is reduced, and the formation of the favorable highlight image is possible. And in this case, the predetermined tone range is defined as the tone range which corresponds to the highlight image.

Second Embodiment

By the way, in the first embodiment, the exposing signal correction step is executed using the conversion pattern in which the correction amount is changed dependent only upon the distance between the cell and the optical axis. However, the optical scanning trouble becomes more apparent as the tone level becomes smaller. Consequently, the conversion pattern may also be structured so that the correction amount Δ changes in accordance with the tone level of the cell to which the pulse belongs.

Figure 14:
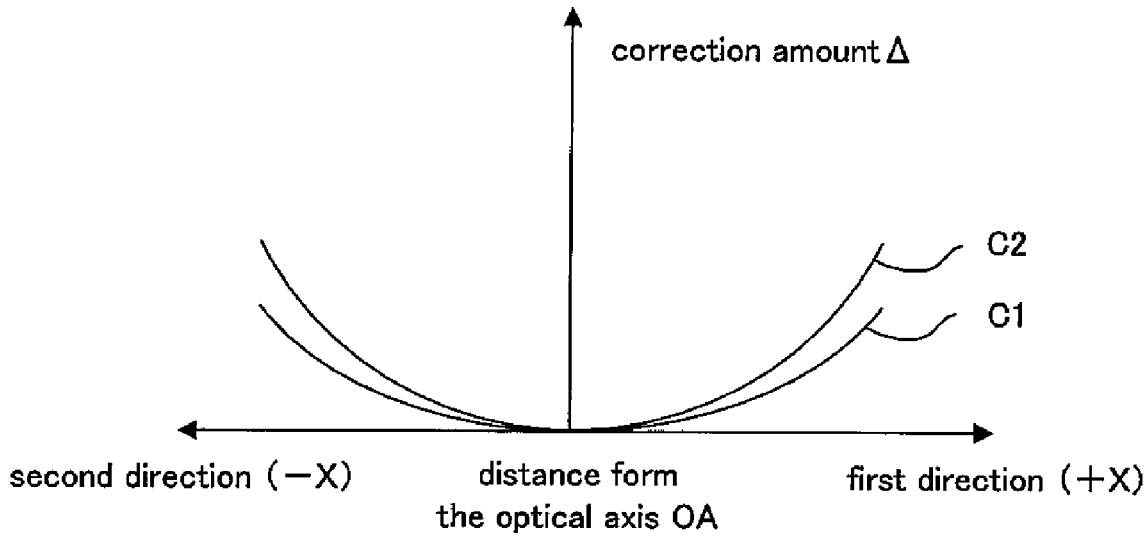
FIG. 14 is a drawing which shows a conversion pattern used in a second embodiment of an optical scanning apparatus according to the invention and an image forming apparatus which comprises the optical scanning apparatus.

FIG. 14 is a drawing which shows a conversion pattern used in a second embodiment of an optical scanning apparatus according to the invention and an image forming apparatus which comprises the optical scanning apparatus. As shown in FIG. 14, a conversion pattern in this embodiment described hereinafter is composed of two correction amount curves C1 and C2 of which the increasing patterns of the correction amount Δ are different from each other, the correction amount Δ due to the increase of the distance in the main scanning direction between the optical axis OA and the cell. Further, the correction amount curves C2 increases the correction amount Δ according to the increase of the distance in the main scanning direction between the optical axis OA and the cell more rapidly than the correction amount curves C1. And these two correction amount curves C1 and C2 are selectively used as follows.

That is, in the case where the tone level of the cell to which the pulse belongs is less than the tone level corresponding to the density of 50%, it is further determined whether or not the tone level of the cell is less than the tone level corresponding to the density of 25%. And in the case where the tone level of the cell is less than the tone level corresponding to the density of 25%, the corrected video signal is generated using the correction amount curve C2, whereas in the case where the tone level of the cell is not less than the tone level corresponding to the density of 25%, the corrected video signal is generated using the correction amount curve C1. This enables to correct the pulse width of the pulse corresponding to the lower tone level wider. Hence, it is preferable that it becomes possible to prevent the occurrence of the optical scanning trouble more surely in the range the tone level is low. The image forming operation is executed based upon such good optical scanning operation, whereby good image formation is also preferably possible in the range the tone level is lower.

In short, in the second embodiment, in view of the fact that the lower the tone level becomes, the more prominent the optical scanning trouble described above becomes, the conversion pattern is structured to make the pulse width larger in accordance with not only the distance between the cell and the optical axis but also the tone level of the cell. By structuring like this, it is preferable that it becomes possible to prevent the occurrence of the optical scanning trouble more surely in the range the tone level is low.

By the way, in the conversion patterns shown in FIGS. 10 and 14, the optimum increasing pattern of the correction amount is different depending upon the interindividual difference of the exposure unit (optical scanning apparatus, exposing section) 6 or the image forming apparatus. Hence, the optimum conversion pattern may be obtained individually to set the factory default. However, such optimum pattern may be different depending upon the change of the environment such as the temperature of the atmosphere even the individual is the same. Consequently, the conversion pattern may be obtained as described in the following third embodiment.

Third Embodiment

Figure 15:
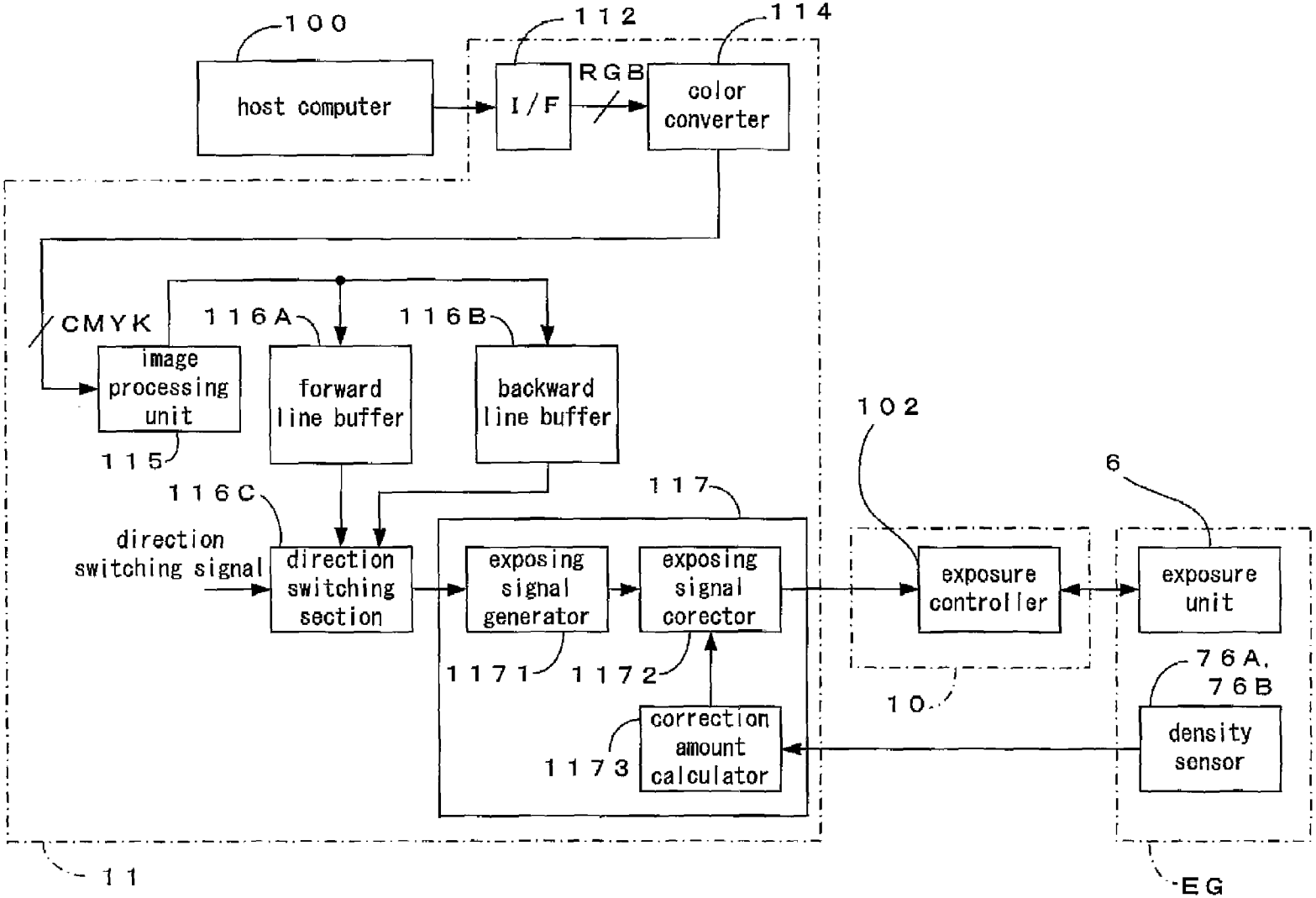
FIG. 15 is a block diagram which shows an electric structure of the third embodiment, the structure executing the setting of the conversion pattern.
Figure 16:
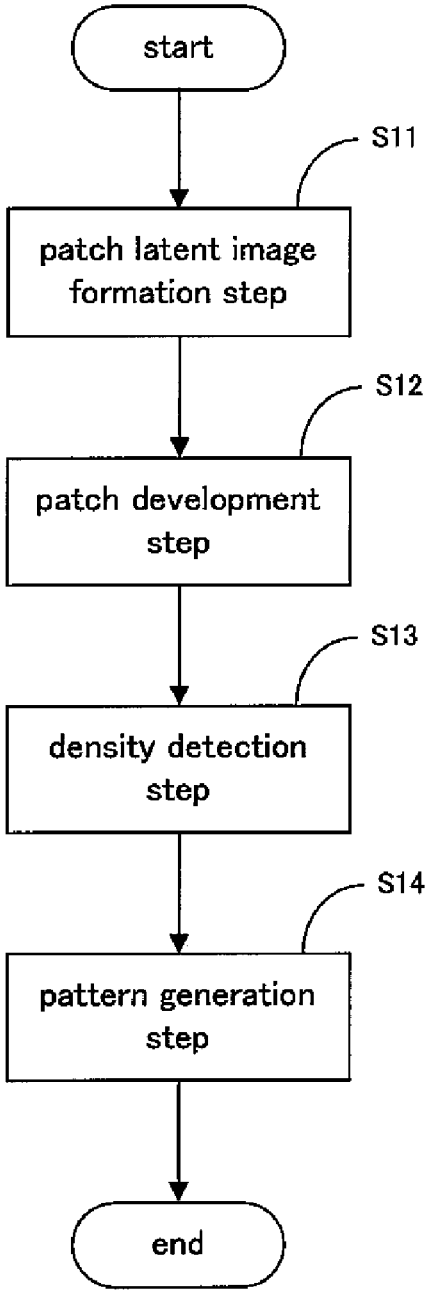
FIG. 16 is a flow chart showing the setting routine of the conversion pattern.
Figure 17:
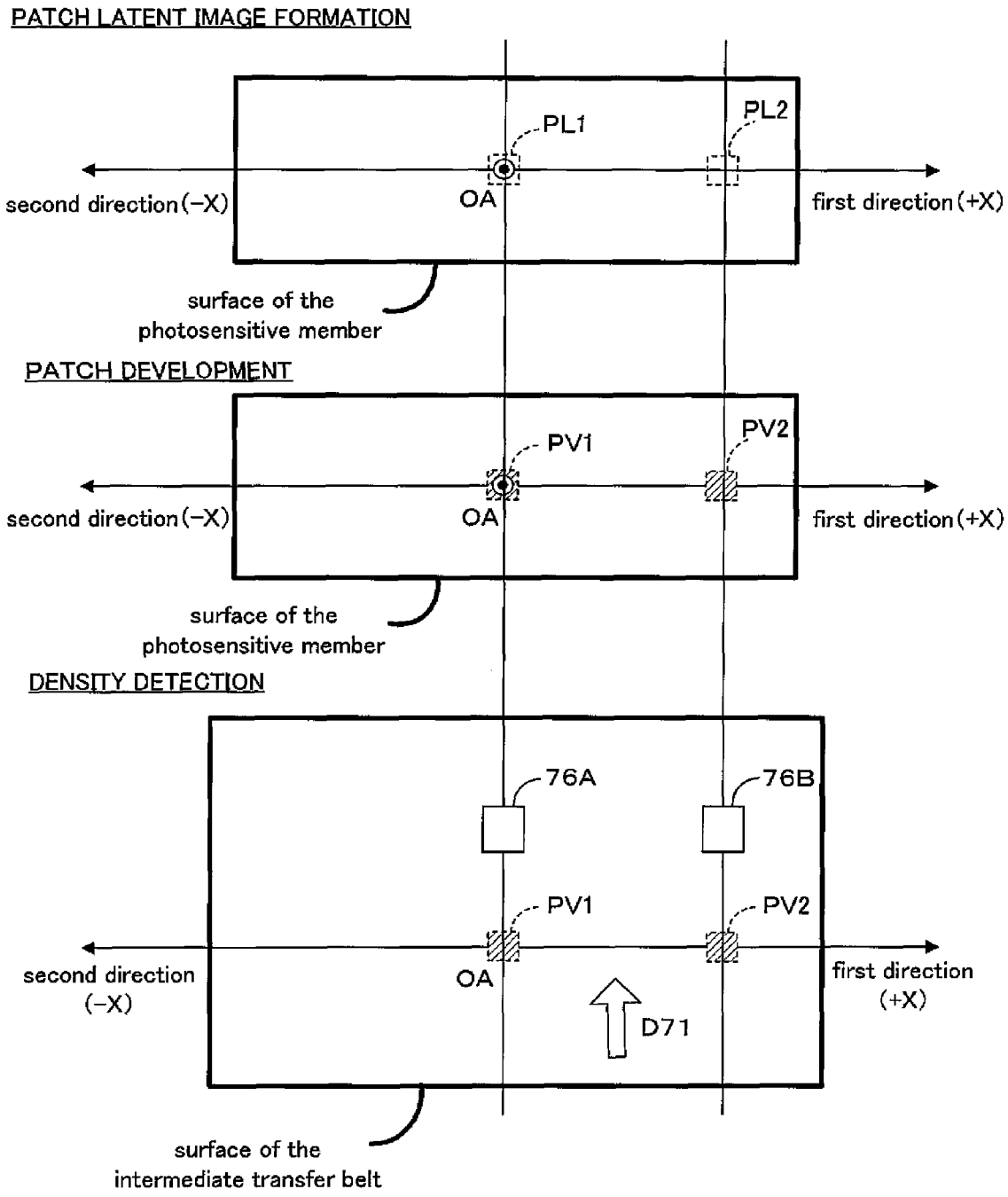
FIG. 17 is a group of drawings which show a position to form a patch latent image formed in setting the conversion pattern.

FIG. 15 is a block diagram which shows an electric structure of the third embodiment, the structure executing the setting of the conversion pattern. Further, FIG. 16 is a flow chart showing the setting routine of the conversion pattern. Further, FIG. 17 is a group of drawings which show a position to form a patch latent image formed in setting the conversion pattern. Meanwhile, since the electric structure shown in FIG. 15 is the same as that shown in FIG. 7 except for the pulse modulating unit 117 and density sensors 76A and 76B, the description of the same part is skipped and only the characterizing part is described. First, a patch latent image formation step is executed to make the exposure unit (optical scanning apparatus, exposing section) 6 execute the optical scanning operation to form two patch latent images PL1 and PL2 corresponding to highlight images on the surface of the photosensitive member 2 (Step S11). At this point, as shown in the upper part "PATCH LATENT IMAGE FORMATION" in FIG. 17, the patch latent image PL1 is formed on the optical axis OA of the scanning optical system, whereas the patch latent image PL2 is formed at a position away from the optical axis OA in the first direction (+X) of the main scanning direction X. Thus, in the third embodiment, these two patch latent images PL1 and PL2 are formed at positions asymmetric to each other relative to the optical axis OA in the main scanning direction X.

Next, a patch development step is executed to make the developer unit 4 develop the patch latent images PL1 and PL2 to form highlight patch images (called merely "highlight images" hereinafter) PV1 and PV2 (Step S12). And, thus formed highlight images PV1 and PV2 are primarily transferred onto the surface of the intermediate transfer belt 71. Since the surface of such intermediate transfer belt 71 cyclically moves in a direction D71 approximately orthogonal to the main scanning direction X, highlight images PV1 and PV2 also moves in the direction D71 with the surface of the intermediate transfer belt 71. As a result, densities of the highlight images PV1 and PV2 are detected respectively by the density sensors 76A and 76B which are provided facing the surface of the intermediate transfer belt 71 at an extension of a moving direction of these highlight images PV1 and PV2 (density detection step, Step S13). And, the densities of the highlight images PV1 and PV2 detected at the density detection step are outputted to a correction amount calculator 1173 in the pulse modulating unit 117, which calculates the optimum conversion pattern based upon these detection results (pattern generation step, Step S14). And, the exposing signal corrector 1172 generates the corrected video signal (corrected exposing signal) based upon thus obtained conversion pattern. The optical scanning operation is executed using thus generated corrected video signal.

In this way, the setting of the conversion pattern shown in FIGS. 16 and 17 is executed to detect the densities of the highlight images formed on the surface of the photosensitive member 2, whereby the difference in the main scanning direction X of the peak value of the distribution of the light quantity of a spot which exposes the surface of the photosensitive member 2 is accurately detected. Hence, from such detection result, it is possible to optimize the conversion pattern based upon the difference of the peak value of the distribution of the light quantity of the spot. As a result, it becomes possible to prevent more surely the occurrence of the optical scanning trouble that the peak value of the distribution of the light quantity of a spot which exposes the surface (surface-to-be-scanned) of the photosensitive member (latent image carrier) is different depending upon a position of the spot in the main scanning direction. And the difference of the image density described above depending upon the position in the main scanning direction is reduced, whereby the formation of the favorable highlight image becomes possible.

Fourth Embodiment

Figure 18:
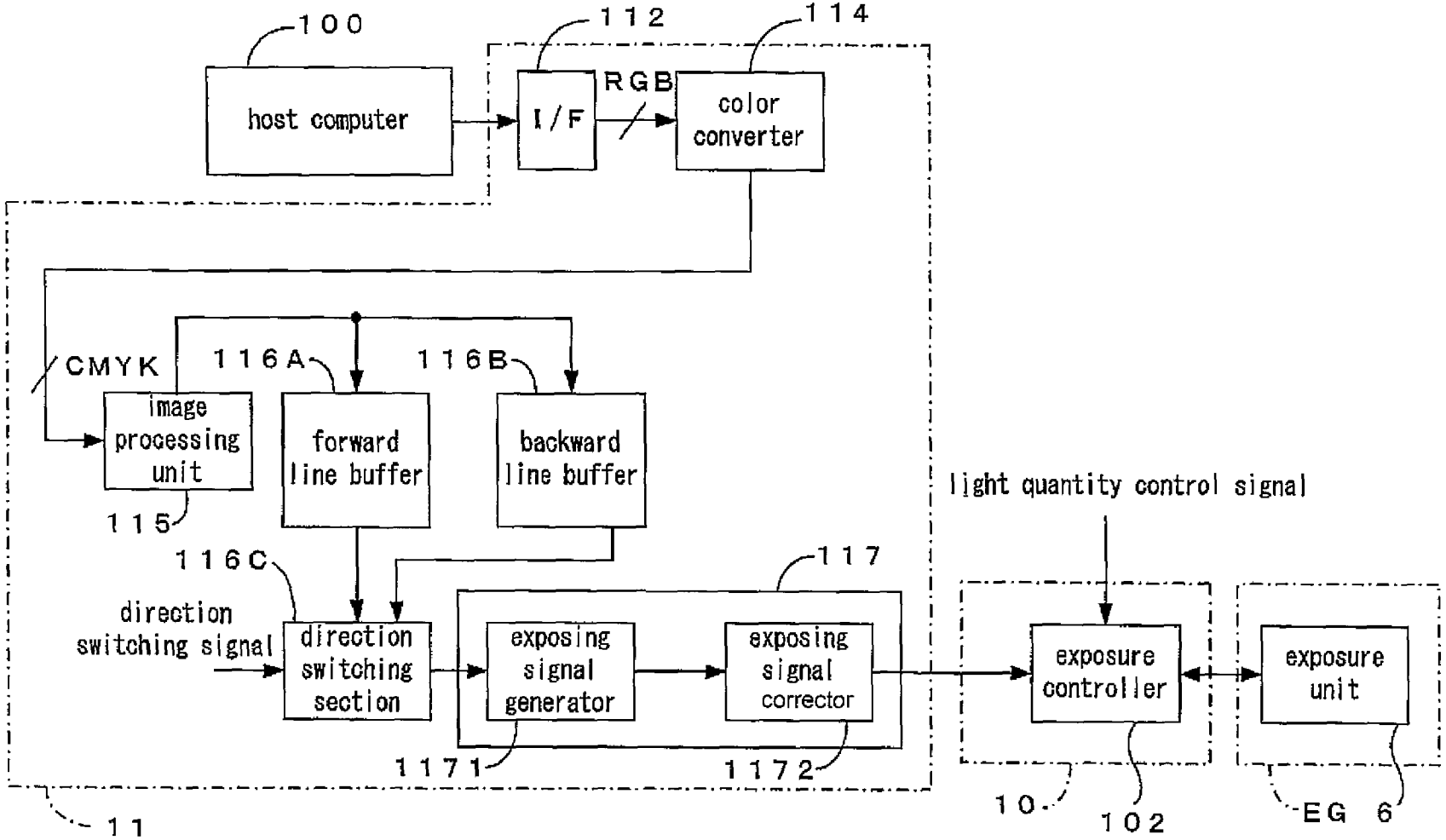
FIG. 18 is a block diagram which shows an electric structure of the image forming apparatus of the fourth embodiment.
Figure 19:
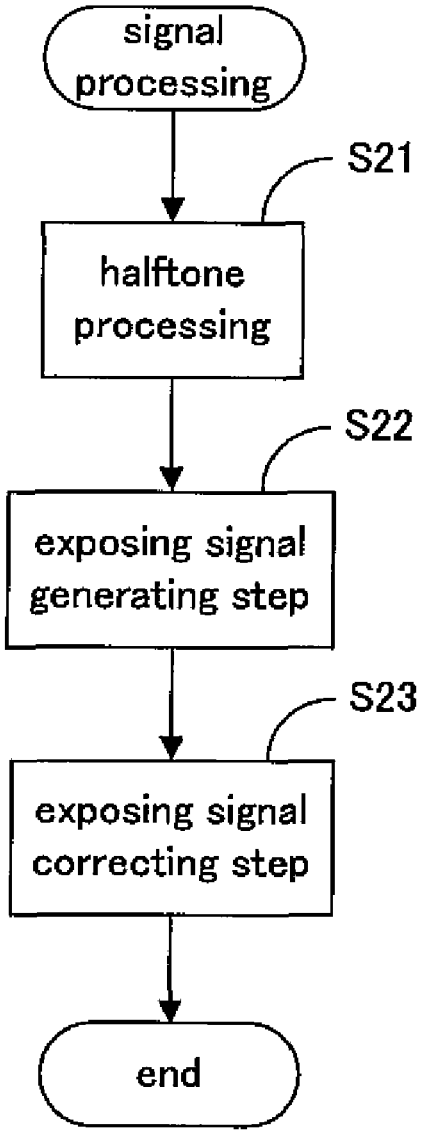
FIG. 19 is a flow chart of the signal processing of the image forming apparatus of the fourth embodiment.
Figure 20:
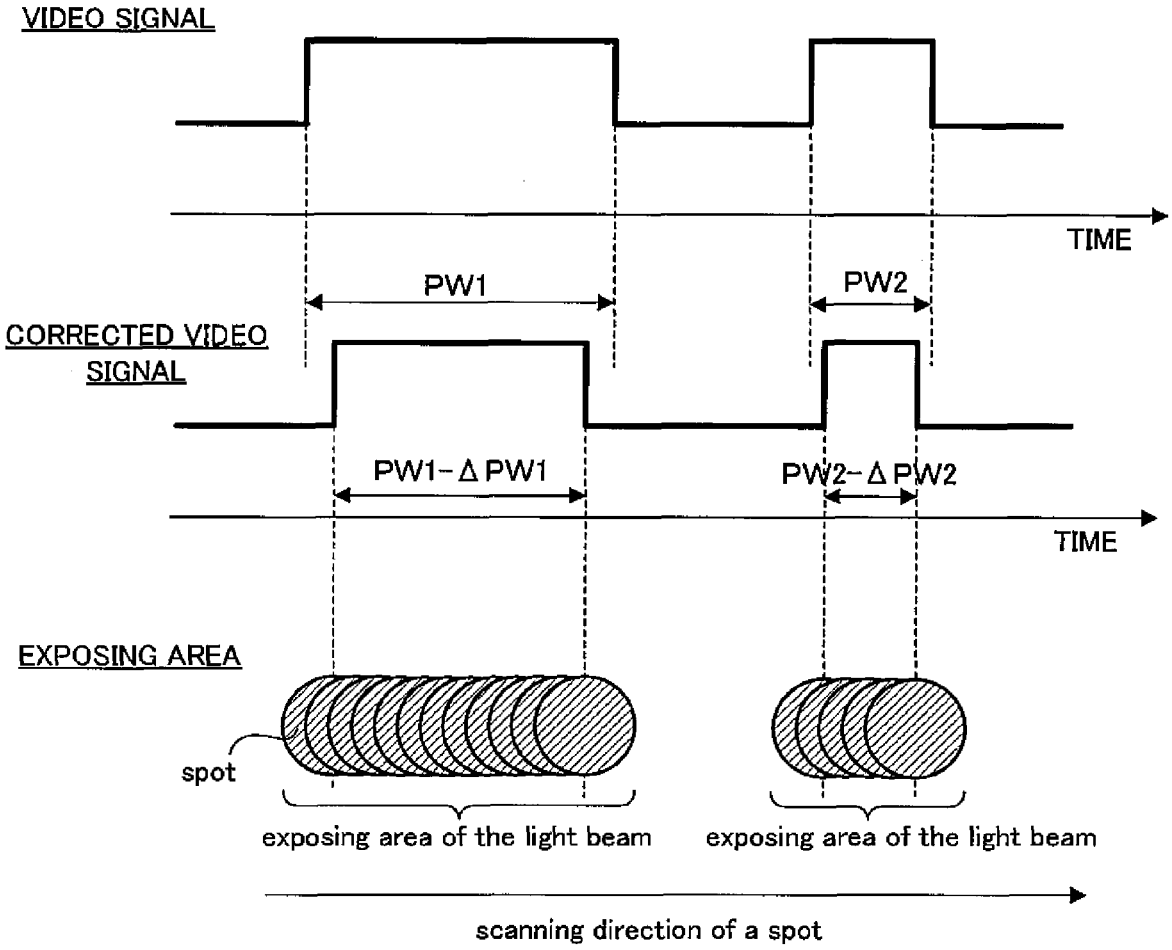
FIG. 20 is a drawing which shows an operation of the signal processing of the image forming apparatus of the fourth embodiment.

A fourth embodiment of the image forming apparatus according to the invention will be described focusing on the signal processing. FIG. 18 is a block diagram which shows an electric structure of the image forming apparatus of the fourth embodiment. Further, FIG. 19 is a flow chart of the signal processing of the image forming apparatus of the fourth embodiment. Further, FIG. 20 is a drawing which shows an operation of the signal processing of the image forming apparatus of the fourth embodiment. The electric structure shown in FIG. 18 is equivalent to the structure arranged to input a light quantity control signal into the exposure controller 102 shown in FIG. 7. Further, the half tone processing (Step S21) and the exposing signal generation step (Step S22) in the flow chart shown in FIG. 19 are approximately the same as the half tone processing (Step S1) and the exposing signal generation step (Step S2) in the flow chart shown in FIG. 8 respectively. So, the description of the same part as the structure already described is skipped and the description is made hereinafter focusing on the characteristic part of the fourth embodiment.

The pulse modulating unit 117 includes an exposing signal generator 1171 and an exposing signal corrector 1172. And, the half-toned tone data inputted to the pulse modulating unit 117 are converted to the video signal (exposing signal) in the exposing signal generator 1171 (exposing signal generating step, Step S22). Such video signal (exposing signal) is generated as a train of pulses which are arranged on the time axis in accordance with the arrangement of the values which the half-toned tone data have, the values indicating exposure/non-exposure of the light beam in the main scanning direction X, the pulses having widths of time corresponding to the length of the exposing area of the light beam in the main scanning direction X.

Next, the video signal generated in this way in the exposing signal generator 1171 is inputted to the exposing signal corrector 1172. The exposing signal corrector 1172 corrects the pulse width PW of each pulse which composes the video signal in accordance with the predetermined conversion pattern, whereby the corrected video signal (corrected exposing signal) is generated (exposing signal correcting step, Step S23).

Figure 21:
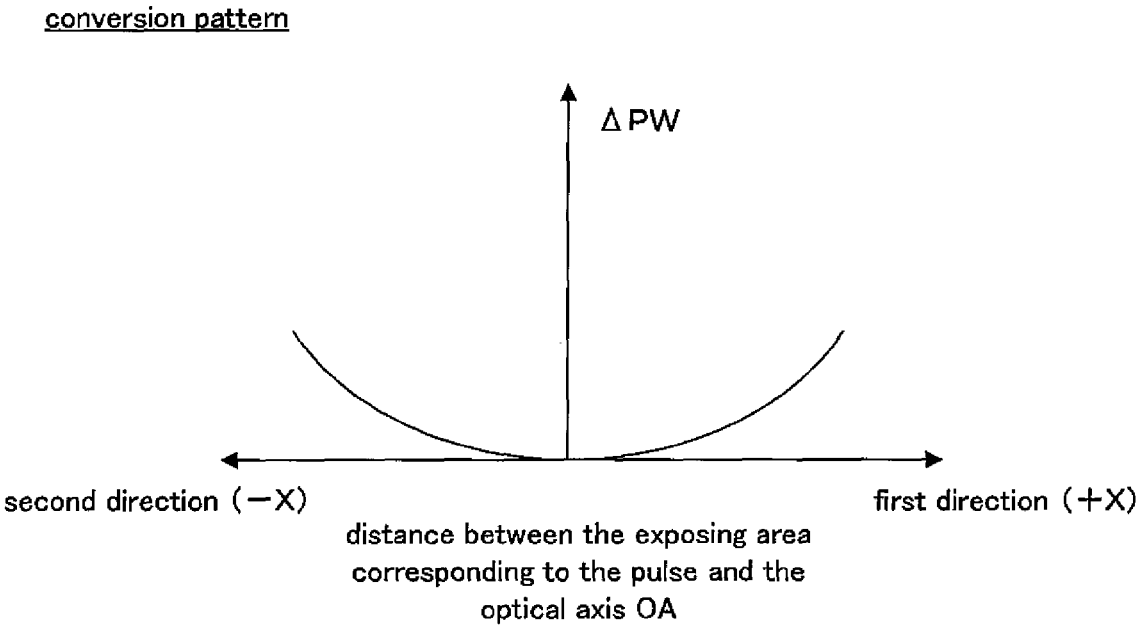
FIG. 21 is a drawing which shows an example of the conversion pattern.

FIG. 21 is a drawing which shows an example of the conversion pattern. At this point, the content of the processing executed in the exposing signal correcting step is described with reference to FIGS. 20 and 21. The exposing signal corrector 1172 corrects the pulse width PW of a pulse which composes the video signal so that the pulse width PW decreases as the distance in the main scanning direction X between the exposing area corresponding to the pulse and the optical axis OA increases, whereby the corrected video signal is obtained from the video signal (exposing signal correcting step, Step S23). For example, in the column "VIDEO SIGNAL" in FIG. 20, two pulses having the pulse widths PW1 and PW2 respectively are shown. The exposing signal corrector 1172 converts the pulse width PW1 to the pulse width (PW1−ΔPW1) and the pulse width PW2 to the pulse width (PW2−ΔPW2), whereby the corrected video signal is generated as shown in the column "CORRECTED VIDEO SIGNAL" in FIG. 20. And, correction amounts ΔPW1 and ΔPW2 are determined based upon the conversion pattern shown in FIG. 21. That is, as shown in FIG. 21, the correction amount ΔPW increases, in other words the pulse width decreases, as the distance between the exposing area corresponding to the pulse and the optical axis OA increases. And, the exposure controller 102 controls ON/OFF of the laser source 62 based upon thus obtained corrected video signal and makes the spot scan a predetermined exposing area, whereby the predetermined exposing area is exposed with the light beam as shown in the column "EXPOSING AREA" in FIG. 20.

Figure 22:
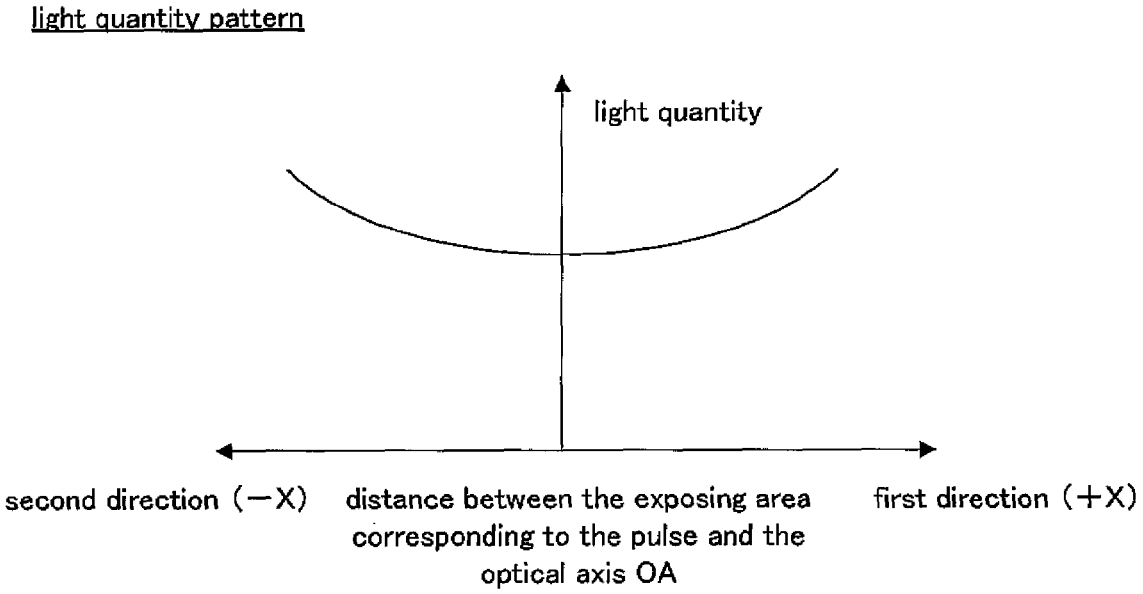
FIG. 22 is a drawing which shows an example of a light quantity pattern to control the light quantity of the light beam emitted from the laser source.

FIG. 22 is a drawing which shows an example of a light quantity pattern to control the light quantity of the light beam emitted from the laser source 62. In this embodiment, the light quantity pattern shown in FIG. 22 is inputted to the exposure controller 102 as the light quantity control signal. That is, the light quantity of the light beam emitted from the laser source 62 is controlled in accordance with such light quantity pattern. And, as shown in FIG. 22, the light quantity pattern is a pattern which increases the light quantity of the light beam emitted from the laser source 62 as the distance in the main scanning direction X between the exposing area of the light beam and the optical axis OA increases. At this point, as for a concrete method of setting the light quantity pattern, the pattern may be set so that the peak value of the distribution of the light quantity of a spot which images on the surface of the photosensitive member is constant regardless of a position of the spot in the main scanning direction X for instance. That is, in this embodiment, the exposure controller (beam modulator) 102 modulates the light beam emitted from the laser source 62 based upon the corrected video signal (corrected exposing signal) while controlling the light quantity of the light beam based upon the light quantity pattern described in FIG. 22 (beam modulating step).

In this embodiment, the light beam deflected by the deflection mirror surface 651 which oscillates sinusoidally exposes the surface of the photosensitive member (latent image carrier) 2 via the scanning optical system composed of the scanning lenses 66 and 68 which has an arcsine characteristics. Therefore, the incident angle of the light beam to the surface of the photosensitive member is different depending upon a position in the main scanning direction. As a result, there may occur an optical scanning trouble that the peak value of the distribution of the light quantity of the light beam which exposes the surface of the photosensitive member becomes maximum in the vicinity of the optical axis OA of the scanning optical system, and decreases with distance from the optical axis.

Figure 23A:
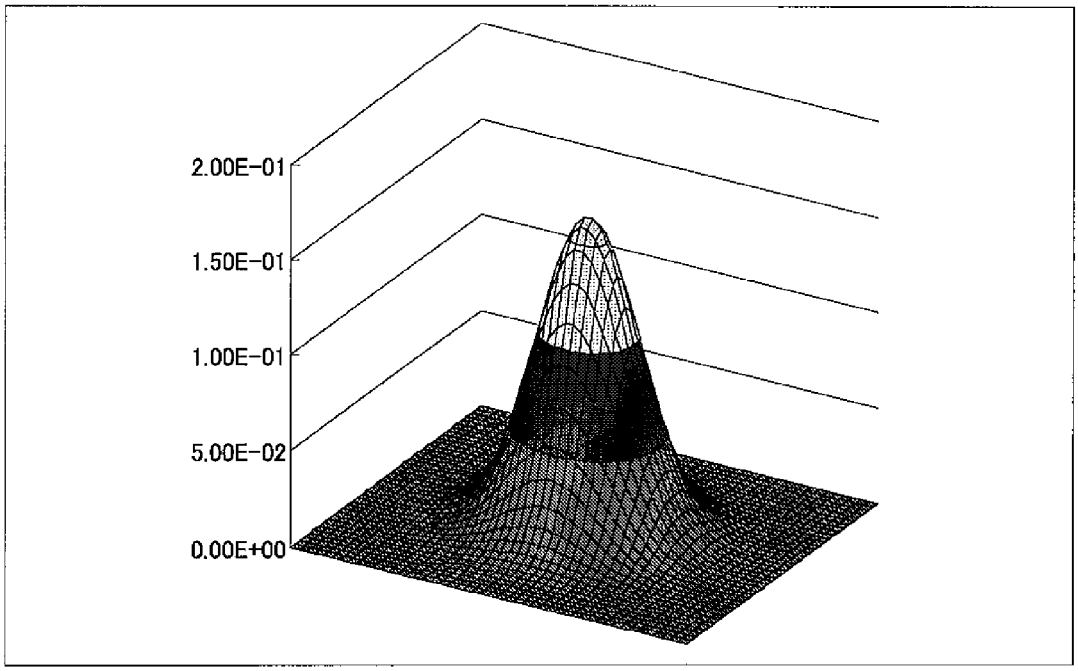
Figure 23B:
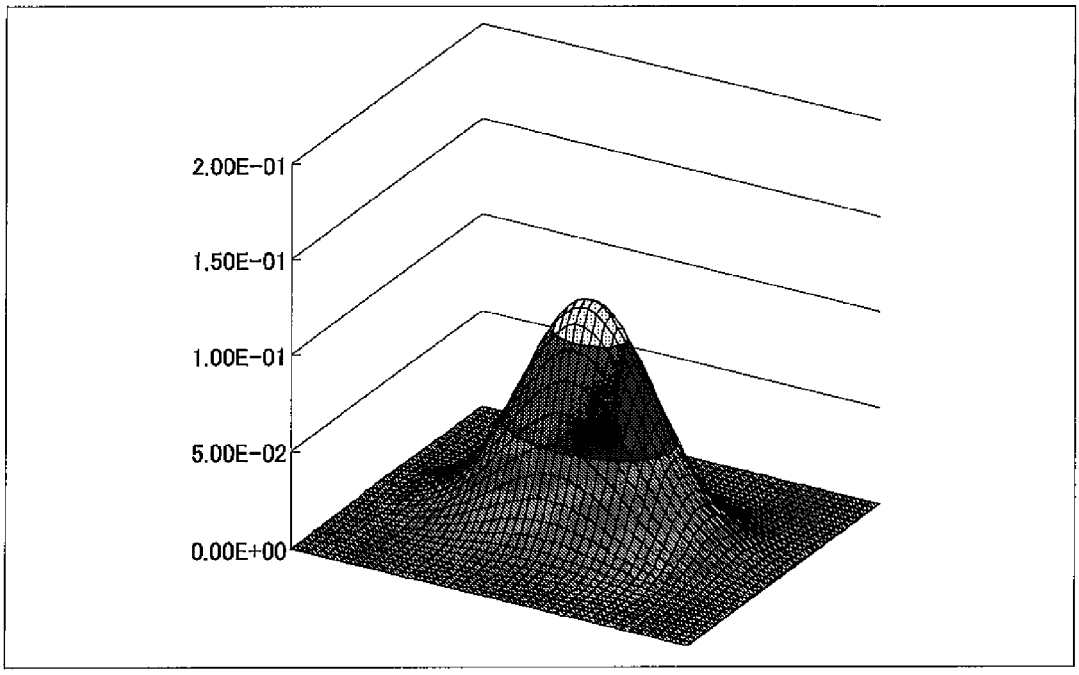
FIG. 23B is a drawing which shows a distribution of the light quantity of a spot at an end part.

FIG. 23A is a drawing which shows a distribution of the light quantity of a spot at a central part, whereas FIG. 23B is a drawing which shows a distribution of the light quantity of a spot at an end part. At this point, an area in the vicinity of the optical axis OA of a scanning target area of the spot is called "central part" and an end part of the scanning target area of the spot is called "end part". As shown in FIGS. 23A and 23B, in such apparatus (image forming apparatus, optical scanning apparatus) described above, the peak value of the distribution of the light quantity of the spot in the central part is high, whereas the peak value of the distribution of the light quantity of the spot in the end part is low. As a result, there occurs an optical scanning trouble that the peak value of the distribution of the light quantity of the light beam which exposes the surface (surface-to-be-scanned) of the photosensitive member (latent image carrier) becomes maximum in the vicinity of the optical axis OA of the scanning optical system, and decreases with distance from the optical axis in the main scanning direction.

Against such problem, in the fourth embodiment, the light quantity of the light beam emitted from the laser source 62 is controlled based upon the light quantity pattern shown in FIG. 22. That is, the spot scans the exposing area in the main scanning direction X based upon the light quantity pattern in which the light quantity of the light beam emitted from the laser source 62 increases as the distance in the main scanning direction X between the exposing area of the light beam and the optical axis OA of the optical scanning system composed of the scanning lenses 66 and 68 increases. Hence, it is possible to prevent the optical scanning trouble that the peak value of the distribution of the light quantity of the light beam which exposes the surface (surface-to-be-scanned) of the photosensitive member (latent image carrier) 2 becomes maximum in the vicinity of the optical axis OA of the scanning optical system composed of the scanning lenses 66 and 68, and decreases with distance from the optical axis in the main scanning direction X.

Incidentally, in the case where the spot scans the exposing area using the deflection mirror surface 651 which oscillates sinusoidally and the scanning optical system composed of the scanning lenses 66 and 68 which has an arcsine characteristics, the incident angle of the light beam to the surface (surface-to-be-scanned) of the photosensitive member (latent image carrier) 2 increases with distance from the optical axis OA. Therefore, the distribution of the light quantity of the spot shows a tendency to become wider with the distance from the optical axis OA. That is, as shown in FIGS. 23A and 23B, the distribution of the light quantity of the spot in the end part shows a tendency not only for the peak value thereof to become lower but also for the distribution to become wider compared to the distribution of the light quantity of the spot in the central part. Especially, the invention which forms the spot based upon the above-mentioned light quantity pattern in which the light quantity is increased in the end part shows such tendency prominently. As a result, in the case where scanning is performed with such spot in the main scanning direction X, the length in the main scanning direction of the area exposed by the light beam may become longer than the desired length.

In response, in the fourth embodiment, the spot scans the exposing area in the main scanning direction X based upon the corrected video signal (corrected exposing signal) corrected using the conversion pattern shown in FIG. 21 in which the pulse width of the pulse is decreased with the distance in the main scanning direction X between the exposing area corresponding to the pulse and the optical axis OA of the optical scanning system composed of the scanning lenses 66 and 68. Hence, it is possible to adjust the length in the main scanning direction of the exposing area exposed by the light beam appropriately regardless of the broadness of the distribution of the light quantity of the spot.

That is, in the fourth embodiment, the spot is formed based upon the light quantity pattern shown in FIG. 22, whereby the decrease of the peak value of the distribution of the light quantity of the light beam exposing the surface of the photosensitive member is prevented. And, the spot scans the exposing area in the main scanning direction X based upon the corrected video signal (corrected exposing signal) corrected using the conversion pattern shown in FIG. 21, whereby the length in the main scanning direction of the exposing area exposed by the light beam is adjusted appropriately. Hence, it is possible to execute optical scanning excellently.

By the way, as for the conversion pattern shown in FIG. 21 and the light quantity pattern shown in FIG. 22, the respective optimum patterns are different depending upon the interindividual difference of the exposure unit (optical scanning apparatus) 6 or the image forming apparatus. Hence, the optimum patterns of the conversion pattern and the light quantity pattern may be obtained individually to set the factory default. However, such optimum patterns may be different depending upon the change of the environment such as the temperature of the atmosphere even the individual is the same. Consequently, the conversion pattern and the light quantity pattern may be obtained as described in the following fifth embodiment.

Fifth Embodiment

Figure 24:
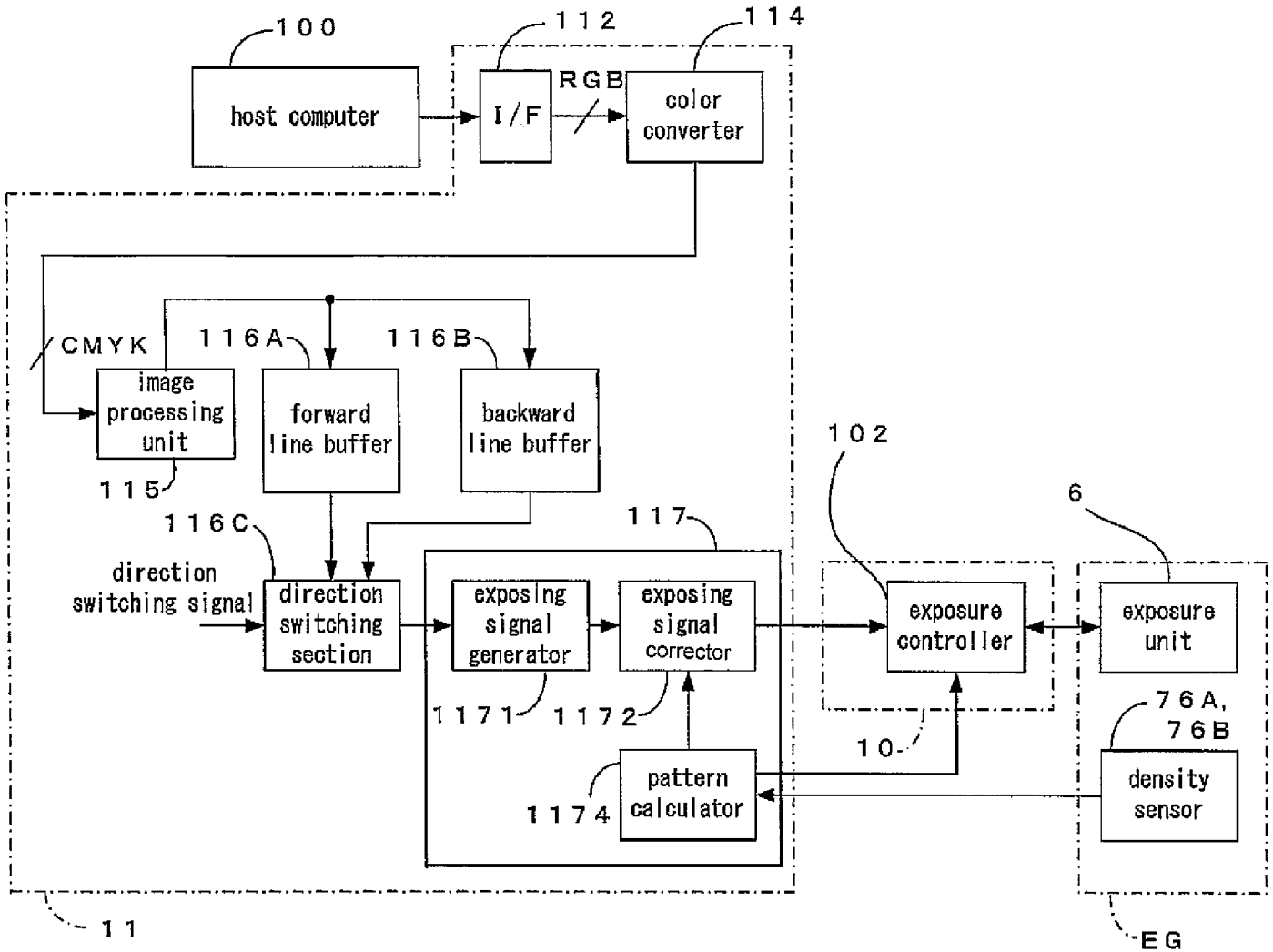
FIG. 24 is a block diagram which shows an electric structure of the fifth embodiment, the structure executing the setting of the conversion pattern and the light quantity pattern.
Figure 25:
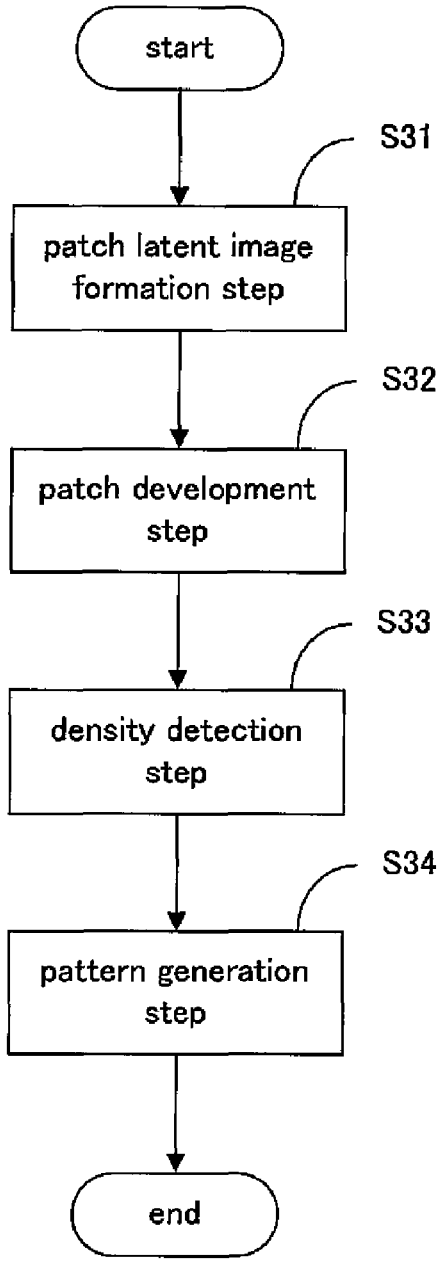
FIG. 25 is a flow chart showing the setting routine of the conversion pattern.
Figure 26:
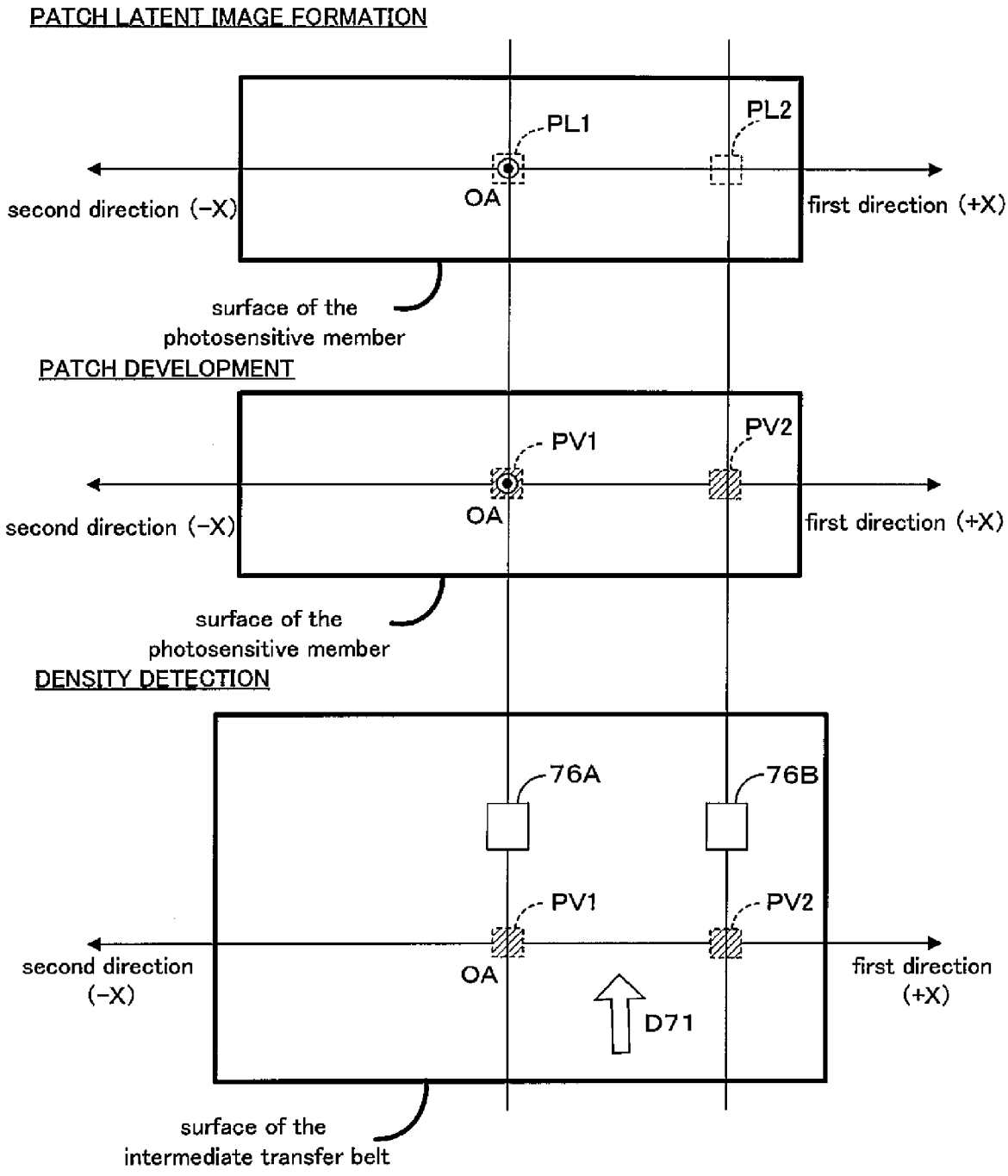
FIG. 26 is a group of drawings which show a position to form a patch latent image formed in setting the conversion pattern.

FIG. 24 is a block diagram which shows an electric structure of the fifth embodiment, the structure executing the setting of the conversion pattern and the light quantity pattern. Further, FIG. 25 is a flow chart showing the setting routine of the conversion pattern and light quantity pattern. Further, FIG. 26 is a group of drawings which show a position to form a patch latent image formed in setting the conversion pattern. Meanwhile, since the electric structure shown in FIG. 24 is the same as that shown in FIG. 18 except for the pulse modulating unit 117, the exposure controller 102 and density sensors 76A and 76B, the description of the same part is skipped and only the characterizing part is described. First, a patch latent image formation step is executed to make the exposure unit (optical scanning apparatus) 6 execute the optical scanning operation to form two patch latent images PL1 and PL2 on the surface of the photosensitive member 2 (Step S31). At this point, as shown in upper part "patch latent image formation" of FIG. 26, the patch latent image PL1 is formed on the optical axis OA of the scanning optical system, whereas the patch latent image PL2 is formed at a position away from the optical axis OA in the first direction (+X) of the main scanning direction X. Thus, in this embodiment, these two patch latent images PL1 and PL2 are formed at positions asymmetric to each other relative to the optical axis OA in the main scanning direction X.

Next, a patch development step is executed to make the developer unit 4 develop the patch latent images PL1 and PL2 to form patch images PV1 and PV2 (Step S32). And, thus formed patch images PV1 and PV2 are primarily transferred onto the surface of the intermediate transfer belt 71. Since the surface of such intermediate transfer belt 71 cyclically moves in a direction D71 approximately orthogonal to the main scanning direction X, the patch images PV1 and PV2 also move in the direction D71 with the surface of the intermediate transfer belt 71. As a result, densities of the patch images PV1 and PV2 are detected respectively by density sensors 76A and 76B which are provided facing the surface of the intermediate transfer belt 71 at an extension of a moving direction of these patch images PV1 and PV2 (density detection step, Step S33). And, the densities of the patch images PV1 and PV2 detected at the density detection step are outputted to a pattern calculator 1174 in the pulse modulating unit 117, which calculates the respective optimum patterns of the conversion pattern and the light quantity pattern based upon these detection results (pattern generation step, Step S34). And, the exposing signal corrector 1172 generates the corrected video signal (corrected exposing signal) based upon the obtained conversion pattern, and the exposure controller 102 controls the light quantity of the light beam emitted from the laser source 62 based upon the obtained light quantity pattern.

In this way, the operation shown in FIGS. 25 and 26 is executed to detect the densities of the patch images formed on the surface of the photosensitive member 2, whereby the difference in the main scanning direction X of the distribution of the light quantity of the light beam which exposes the surface of the photosensitive member 2 is accurately detected. Hence, from such detection result, it is possible to optimize the conversion pattern and the light quantity pattern based upon the difference in the main scanning direction X of the distribution of the light quantity of the light beam. As a result, it becomes possible to prevent more surely the occurrence of the optical scanning trouble that the distribution of the light quantity of the light beam which exposes the surface (surface-to-be-scanned) of the photosensitive member (latent image carrier) is different depending upon a position of the light beam in the main scanning direction. And it is preferable that good image formation is possible.

Incidentally, in the embodiment described above, as an example of the concrete method of setting the light quantity pattern, the pattern is set so that the peak value of the light quantity of a spot is constant regardless of the position of the spot in the main scanning direction X. That is, in such a case, the pattern is set so that the peak value of the light quantity of a spot is constant regardless of the position of the spot in the main scanning direction X, whereby the variation of the peak value of the distribution of the light quantity of the light beam, which exposes the surface of the photosensitive member, is suppressed. And, the spot scans the surface in the main scanning direction X based upon the corrected video signal (corrected exposing signal) corrected by means of the conversion pattern shown in FIG. 21, in order to optimize the length in the main scanning direction of the exposing area exposed by the light beam based upon such light quantity pattern.

However, the concrete method of setting the light quantity pattern is not limited to this. The light quantity pattern may be set so that the peak value of the light quantity of the light beam which exposes a single pixel is constant regardless of the position of the light beam in the main scanning direction, as described in a following sixth embodiment for instance. And, it may be structured that the spot scans the surface in the main scanning direction X using the conversion pattern which optimizes the length in the main scanning direction of the exposing area exposed by the light beam based upon such light quantity pattern.

Sixth Embodiment

Figure 27:
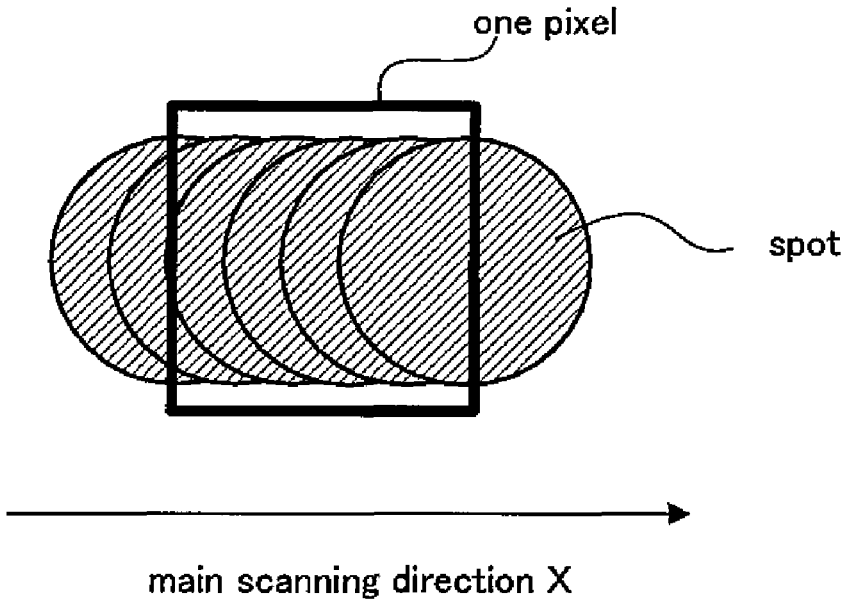
FIG. 27 is a drawing which shows an appearance of a spot scanning a single pixel.

FIG. 27 is a drawing which shows an appearance of a spot scanning a single pixel. The spot scans the surface of the photosensitive member in the main scanning direction X, whereby the light beam necessary to expose a single pixel exposes the surface as shown in FIG. 27. Hence, such distribution of the light quantity of the light beam exposing a single pixel is equal to an accumulation of the light quantity of the spots scanning the single pixel.

Figure 28A:
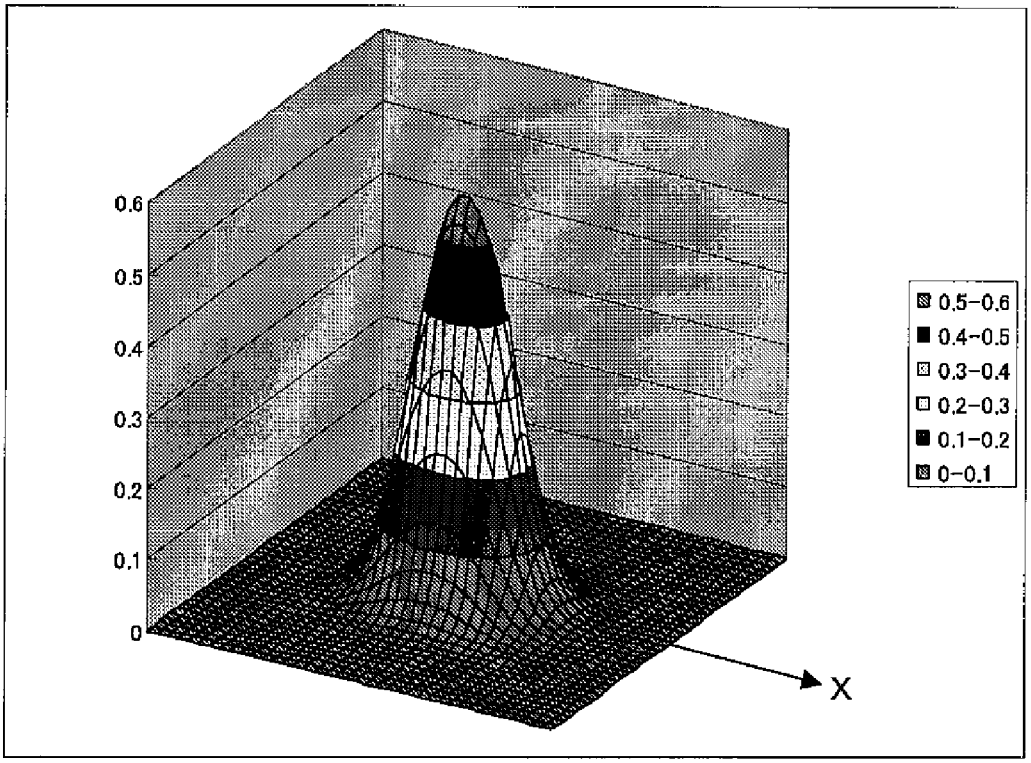
FIG. 28A is a drawing which shows a simulation result of the distribution of the light quantity of the light beam exposing a single pixel at the central part.
Figure 28B:
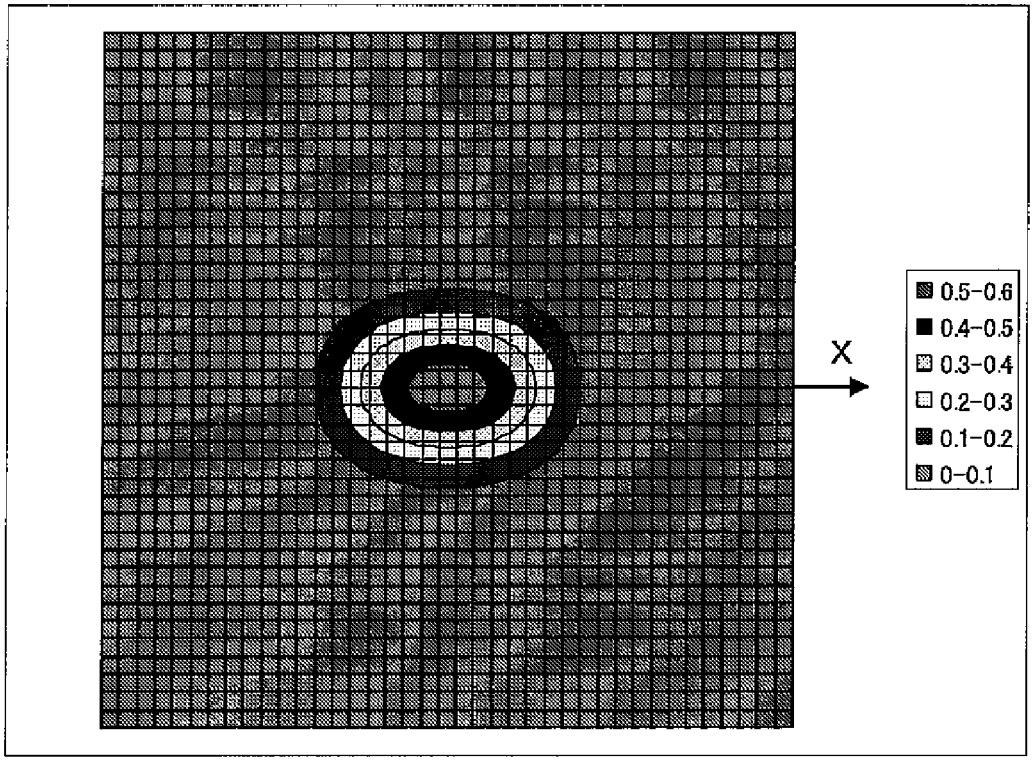
FIG. 28B is a drawing which shows the light quantity in FIG. 28A viewed from the surface normal of the photosensitive member.
Figure 29A:
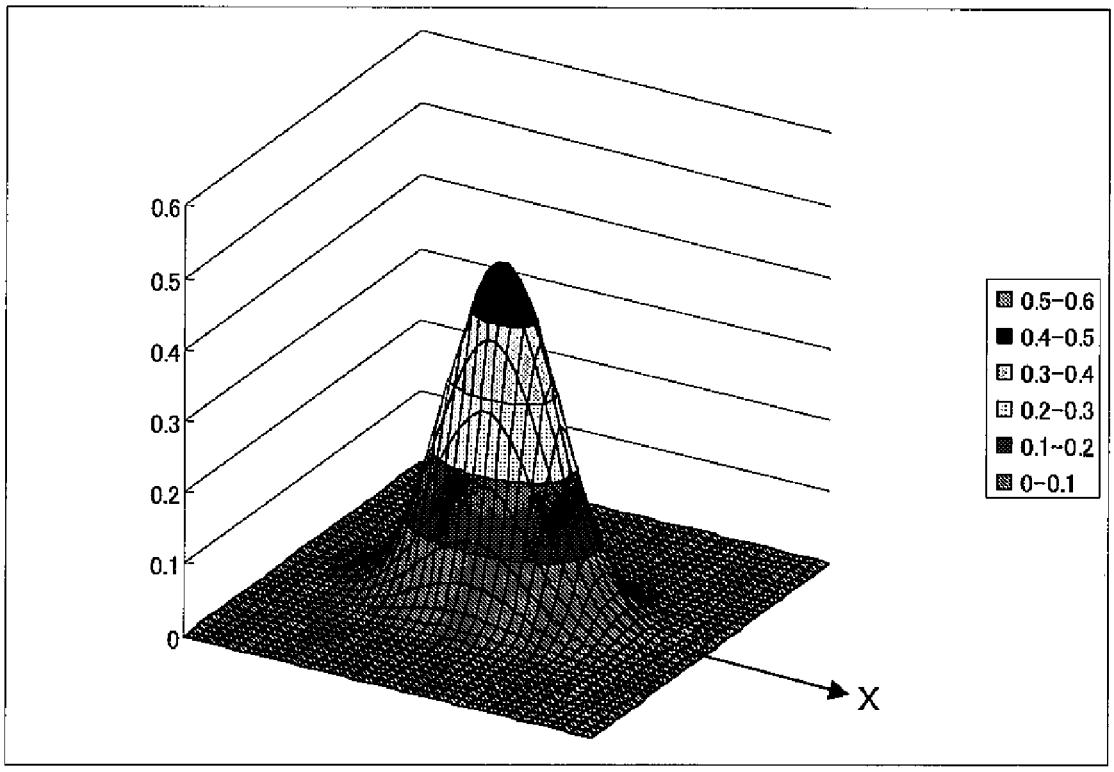
FIG. 29A is a drawing which shows a simulation result of the distribution of the light quantity of the light beam exposing a single pixel at the end part in which the light quantity and the pulse width are the same as those in FIG. 28A.
Figure 29B:
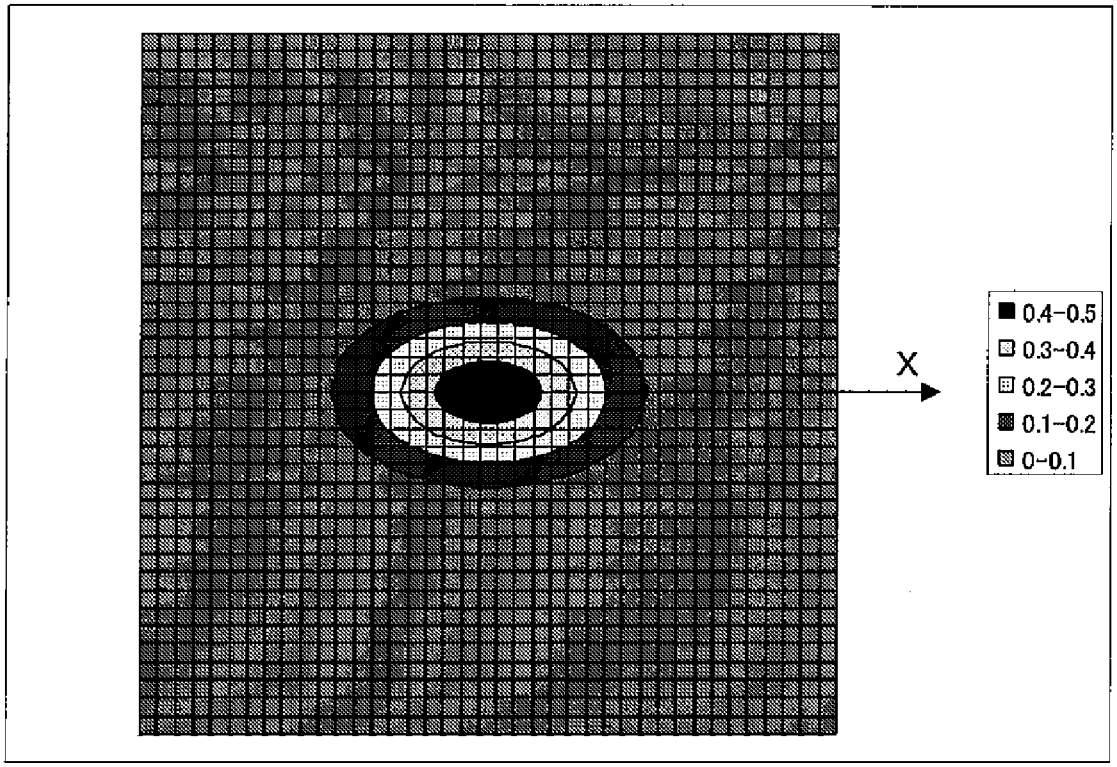
FIG. 29B is a drawing which shows the light quantity in FIG. 29A viewed from the surface normal of the photosensitive member.

FIG. 28A is a drawing which shows a simulation result of the distribution of the light quantity of the light beam exposing a single pixel at the central part. FIG. 29A is a drawing which shows a simulation result of the distribution of the light quantity of the light beam exposing a single pixel at the end part in which, the light quantity and the pulse width are the same as those in FIG. 28A. FIGS. 28B and 29B are drawings which show the light quantity in FIGS. 28A and 29A viewed from the surface normal of the photosensitive member respectively. Further, each unit of the figures in FIGS. 28A to 29B is $\mu J/cm^2$.

Each simulation shown in FIGS. 28A to 29B is executed under the condition that a spot whose diameter is 44 μm at the central part and 66 μm at the end part scans a single pixel of 600 dpi (dots per inch) of resolution at the scanning speed of 2709 m/sec. Further, the light quantity is 5.2 mW which is constant both at the central part and the end part.

As shown in FIGS. 28A to 29B, as for the distribution of the light quantity of the light beam which exposes a single pixel, the peak value thereof is lower and the distribution is wider at the end part than those at the central part. So, the conversion pattern and the light quantity pattern may be obtained so that the distribution of the light quantity of the light beam which exposes a single pixel at the central part is approximately equal to that at the end part. That is, in the following exemplified way, the light quantity pattern may be set so that the peak value of the distribution of the light quantity of the light beam which exposes a single pixel is constant, and the conversion pattern may be obtained so that the length in the main scanning direction of the distribution of the light quantity of the light beam which exposes a single pixel is constant, both regardless of the position in the main scanning direction X.

Each scanning speed in the simulation shown in FIGS. 28A to 29B is 2709 m/sec. Hence, the time period to scan a single pixel in the main scanning direction X, that is, the time period to scan the distance 42.3 μm at the scanning speed is 15.6 nsec. To be more specific, the laser source 62 is driven with a pulse whose pulse width is 15.6 nsec, whereby the spot scans a single pixel. Consequently, in order to reduce the difference of the distribution of the light quantity shown in FIGS. 28 and 29, the light quantity is increased to 9.2 mW and the pulse width of a pulse which drives the laser source 62 is shortened to 10 nsec at the end part.

Figure 30A:
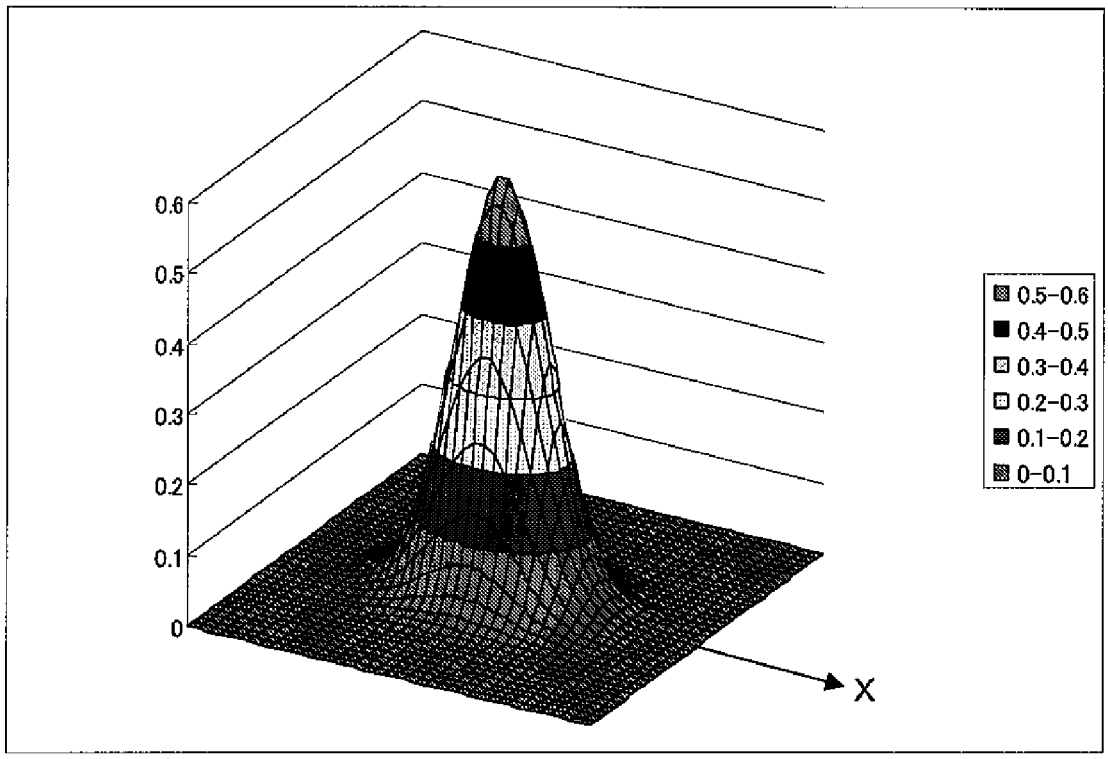
FIG. 30A is a drawing which shows a simulation result of the distribution of the light quantity of the light beam exposing a single pixel at the end part.
Figure 30B:
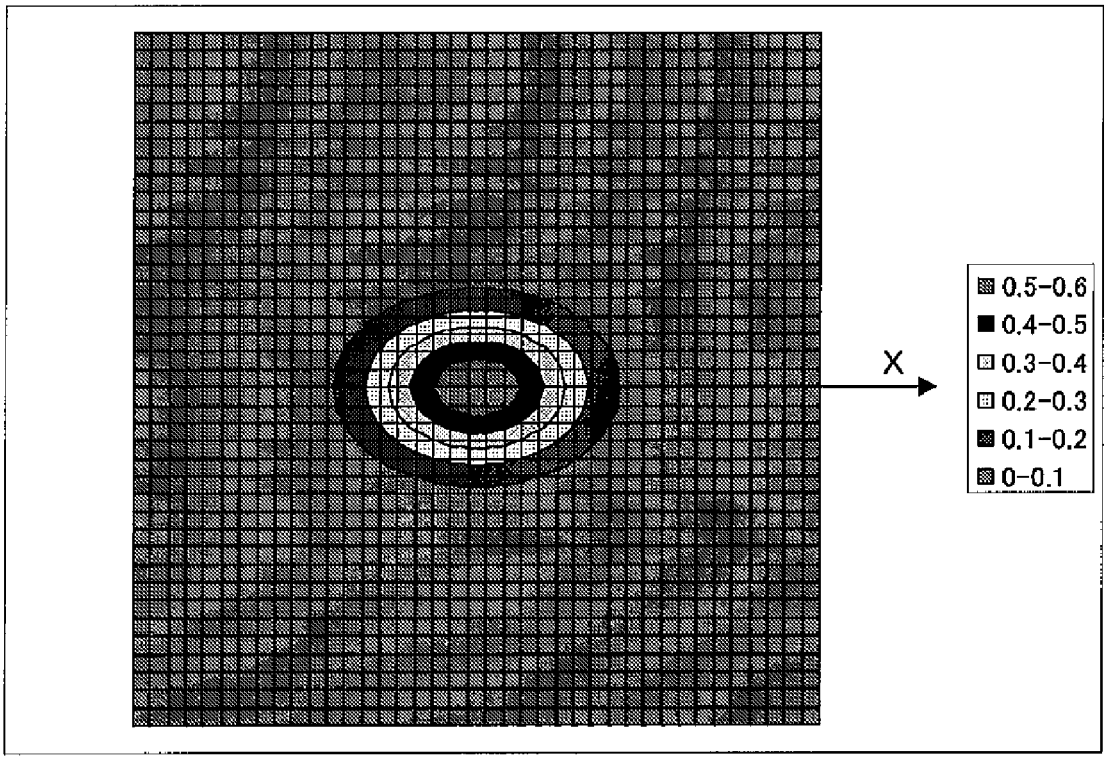
FIG. 30B is a drawing which shows the light quantity in FIG. 30A viewed from the surface normal of the photosensitive member.

FIG. 30A is a drawing which shows a simulation result of the distribution of the light quantity of the light beam exposing a single pixel at the end part in the case where the conditions of the light quantity and the pulse width are changed in this way. FIG. 30B is a drawing which shows the light quantity in FIG. 30A viewed from the surface normal of the photosensitive member. Each unit of the figures in FIGS. 30A and 30B is $\mu J/cm^2$. It is realized, as shown in FIGS. 30A and 30B, that the distribution of the light quantity at the end part shown in FIGS. 30A and 30B can be made approximately equal to that at the central part shown in FIGS. 28A and 28B by changing the conditions of the light quantity and the pulse width as described above.

It is to be noted that the invention is not limited to the foregoing embodiments and various changes and modifications other than the above may be made thereto unless such changes and modifications depart from the scope of the invention. For instance, in the first to third embodiments, a predetermined tone range is defined as the range less than the tone level corresponding to the density of 50%, that is, the tone range of the tone level 0 to 127, but the predetermined tone range is not limited to this. However, since the adverse effect on an image described above becomes strongly apparent in the highlight image, it is preferable that the predetermined tone range is defined as a tone range corresponding to the highlight image or a range which includes the tone range corresponding to the highlight image.

Further, in FIG. 9, the leading edge of the pulse which composes the video signal is coincided with the leading edge of the corrected video signal. However, it is possible to change whether these leading edges are coincided or not when needed.

Further, in the conversion patterns shown in FIGS. 10 and 14, the correction amount Δ increases continuously as the distance between the cell and the optical axis OA increases, but the increasing mode of the correction amount Δ is not limited to this. The correction amount Δ may increase in a stepwise fashion.

Further, in FIG. 14, the conversion pattern is composed of two correction amount curves C1 and C2. However, the number of the correction amount curve which composes the conversion pattern is not limited to two but may be changed when needed.

Further, in the pattern generation step in the third embodiment, only the conversion pattern is obtained based upon the detection result in the density detection step, and the predetermined tone range which is a criterion whether to change the pulse width by means of the conversion pattern is not changed as the tone levels 0 to 127. However, it may be structured that the optimum range of the predetermined tone range is obtained based upon the detection result in the density detection step. In this case, it becomes possible to execute the optical scanning operation in the optimum predetermined tone range, and it is preferable that the optical scanning trouble is more surely prevented.

Further, in the fourth to sixth embodiments, as the concrete method of setting the light quantity pattern, (1) the method that the peak value of the light quantity of a spot is constant regardless of the position of the spot in the main scanning direction, and (2) the method that the peak value of the light quantity of the light beam which exposes a single pixel is constant regardless of the position of the light beam in the main scanning direction, are described, but the concrete method of setting the light quantity pattern is not limited to these. The point is, the spot scans the surface in the main scanning direction X based upon the light quantity pattern which increases the light quantity of the light beam emitted from the laser source 62 as the distance in the main scanning direction X between the exposing area of the light beam and the optical axis OA of the scanning optical system composed of the scanning lenses 66 and 68 increases. Hence, it is possible to achieve the effect to reduce the variation of the peak value of the distribution of the light quantity.

Further, in the conversion pattern shown in FIG. 21, the correction amount ΔPW increases continuously with the distance from the optical axis OA, but the increasing mode of the correction amount ΔPW is not limited to this. The correction amount ΔPW may increase in a stepwise fashion.

Further, in the light quantity pattern shown in FIG. 22, the light quantity increases continuously with the distance from the optical axis OA, but the increasing mode of the light quantity is not limited to this. The light quantity may increase in a stepwise fashion.

Further, in the pattern generation step (Step S34) shown in FIG. 25, the conversion pattern and the light quantity pattern are both obtained based upon the detection result in the density detection step (Step S33). However, only the pattern which easily varies by the change of the environment such as the temperature of the atmosphere may be obtained in the pattern generation step (Step S34) among these two patterns. That is, for instance, the light quantity pattern may be fixed to a pattern obtained by a simulation and the like in advance, whereas the pattern generation step may be structured so that only the conversion pattern is obtained. It is possible to simplify the sequence executed in the pattern generation step when it is structured like this.

Further, in the each patch latent image formation step in the third and fifth embodiments described above, the patch latent image PL1 of the two patch latent images PL1 and PL2 is formed on the optical axis OA, but the position to form the patch latent image PL1 is not limited on the optical axis OA. Further, at this point, the two patch latent images PL1 and PL2 are formed at positions asymmetric to each other relative to the optical axis OA in the main scanning direction X, but the positions to form the patch latent images are not limited to these positions. However, in the case where the patch latent images PL1 and PL2 are formed at positions asymmetric to each other relative to the optical axis OA in the main scanning direction X, it is preferable that the influence of the above-mentioned optical scanning trouble on the image density is prevented more effectively and it becomes possible to form better images. The reason will be described next.

It is often structured that the optical scanning apparatus like the one described above is symmetric relative to the optical axis OA of the scanning optical system composed of the scanning lenses 66 and 68. In these cases, when the relative positions of the two patch images PV1 and PV2 formed by executing the patch latent image formation step and the patch development step are symmetric to each other relative to the optical axis OA of the scanning optical system, the densities of the two patch images PV1 and PV2 are approximately equal. On the other hand, in the case where the two patch latent images PL1 and PL2 are formed at positions asymmetric to each other relative to the optical axis OA of the scanning optical system composed of the scanning lenses 66 and 68 in the main scanning direction X in the patch latent image formation step, the densities of the two patch images formed by executing the patch latent image formation step and the patch development step are different from each other without depending upon the symmetry of the apparatus configuration. Hence, it is possible to detect accurately the variation in the main scanning direction of the peak value of the distribution of the light quantity of the light beam which exposes the surface (surface-to-be-scanned) of the photosensitive member (latent image carrier). Hence, it becomes possible to optimize the conversion pattern better As a result, the above-mentioned difference of the image density depending upon the position in the main scanning direction is reduced more accurately, and it is preferable that it becomes possible to form better images.

Further, in the each patch latent image formation step in the third and fifth embodiments, the two patch latent images PL1 and PL2 are formed, but the number to form the patch latent images is not limited to this. It is possible to reduce the difference in the main scanning direction of the peak value of the distribution of the light quantity of the light beam which exposes the surface of the photosensitive member 2 as described above by forming plural patch latent images.

Further, in the density detection step in the third and fifth embodiments, the density of the patch images PV1 and PV2 which are primarily transferred onto the surface of the intermediate transfer belt 71 are detected, but the structure of the density detection step is not limited to this. It may be structured that the density of the patch images which are formed on the photosensitive member 2, or the patch images which are fixed on the sheet S are detected.

Further, in the embodiments described above, the oscillating deflection mirror surface 651 is made using a micro machining technique, but the production method of the deflection mirror surface is not limited to this. The invention is applicable to the so-called image forming apparatus in general in which the light beam is deflected by means of the oscillating deflection mirror surface, whereby the light beam scans the surface of the latent image carrier.

Further, in the embodiments described above, the invention is applied to the image forming apparatus in which the color image is temporarily formed on the intermediate transfer medium such as the intermediate transfer belt and then, the color image is transferred onto the sheet S, but the invention is also applicable to an apparatus in which each toner image is directly superimposed on the sheet to thereby form the color image.

Further, the embodiments are described using the printers which print an image based on a print command supplied from the external apparatus such as a host computer on the sheet S such as a transfer sheet and a copier sheet, the image included in the image command, but the invention is not limited to this. The invention is also applicable to electrophotographic image forming apparatuses in general including copiers, facsimiles and the like.

Further, in the embodiments described above, the invention is applied to the color printer of a so-called 4 cycle type, but the scope of the invention is not limited to this. That is, the invention is also applicable to a color printer of a so-called tandem type in which a plurality of image forming stations are arranged in a moving direction of the intermediate transfer belt. Further, the invention is also applicable to a monochromatic printer which performs only a monochromatic printing.

Further, in the halftone processing in the above-described embodiments, the same dither matrix is used for all the cells, but the number of the dither matrix is not limited to one, and it may be structured that plural matrixes are selectively used when needed. However, it is preferable to use the same dither matrix in all the cells from the viewpoint of the simplification of the structure.

EXAMPLES

The invention will be understood more readily with reference to the following examples; however these examples are intended to illustrate the invention and not to be construed to limit the scope of the invention.

First Example in the first example, the optical scanning apparatus and the image forming apparatus including the optical scanning apparatus which are described in "DESCRIPTION OF EXEMPLARY EMBODIMENTS" are used. Further, the optical scanning apparatus used in the first example is able to oscillate the deflection mirror surface at a frequency of 5 KHz, to realize the resolution of 600 dpi in the sub scanning direction Y when the scanning is performed only in one direction of the main scanning direction X, and to realize the resolution of 1200 dpi in the sub scanning direction Y when the scanning is performed in both directions of the main scanning direction X.

In the first example, three highlight images of the density of 10%, that is the tone level being 26, are formed in the main scanning direction X, and the optimum conversion pattern which is used in generating the corrected exposing signal is obtained based upon the density of the highlight image. Further, in this example, the CMYK tone data are converted to the half-toned tone data by comparing to the dither matrix described hereinafter. Meanwhile, as described in "DESCRIPTION OF EXEMPLARY EMBODIMENTS", the CMYK tone data are generated based upon the image data inputted from the host computer, and WORD of Microsoft Corporation is used in generating the image data.

FIGS. 31 and 32 are drawings which show the dither matrix used in the first example. That is, FIG. 31 shows a basic configuration of the dither matrix used in the first example, and the dither matrix has a structure of 4 rows and 4 columns in accordance with the cell used. And, in FIG. 31, the 16 threshold levels the dither matrix has as the elements are represented by the reference characters A to P of the alphabet.

FIG. 32 is a drawing which shows the specific threshold levels of the dither matrix MTX which is used in forming the highlight images of the above-mentioned density of 10%, that is the tone level being 26. The description "T TO U: LEFT-ALIGNING" in FIG. 32, where T and U are integers, means that the half-toned tone data (pattern data) are generated so that the spot exposes each target pixel from left-aligning of 0/16 pixel to left-aligning of (U−T)/16 pixel when the tone level is from T to U. To be more specific, as for the threshold level G for instance, "96 TO 111: LEFT-ALIGNING" means that each from left-aligning of 0/16 pixel to left-aligning of (U−T)/16 pixel is executed in accordance with the tone level from 96 to 111. Further, the description "T TO U: RIGHT-ALIGNING" means, in the same way, that the pattern data are generated so that the spot exposes each target pixel from right-aligning of 0/16 pixel to right-aligning of (U−T)/16 pixel when the tone level is from T to U. Further, the description "T TO U: SINGLE PIXEL" means that the pattern data are generated so that the spot exposes the whole area of the target pixel when the tone level is from T to U.

Figure 33:
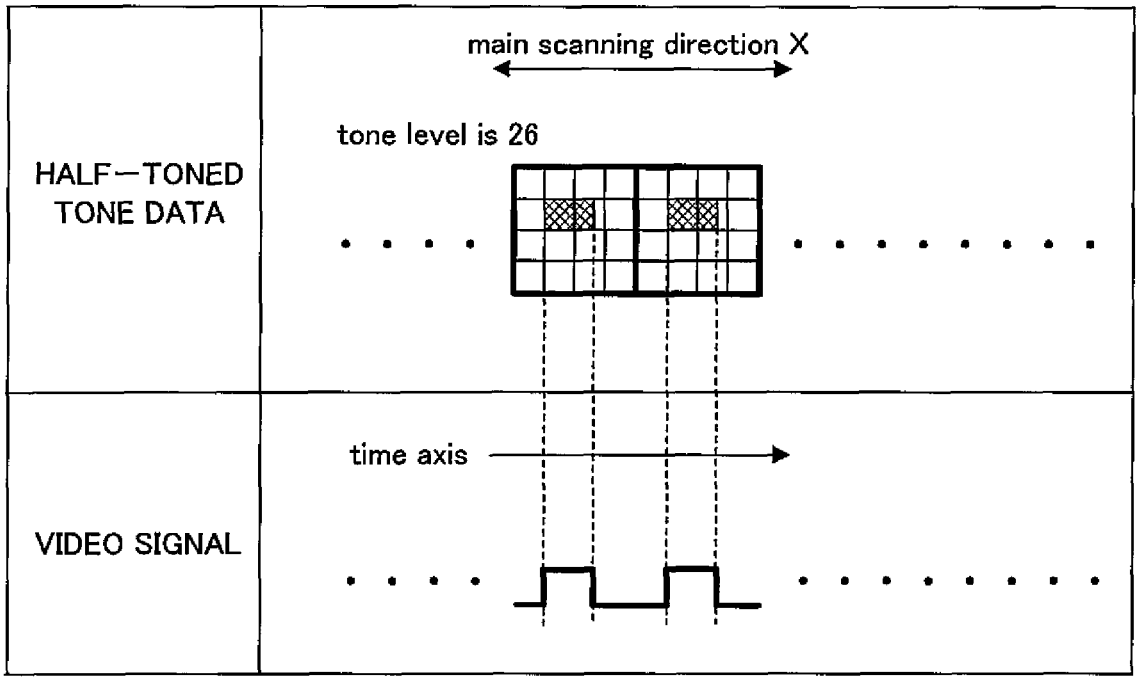
FIG. 33 is a group of drawings which show the half-toned tone data and the video signal of the tone level being 26.

FIG. 33 is a group of drawings which show the half-toned tone data and the video signal of the tone level being 26. The half-toned tone data (pattern data) of the density of 10%, that is the tone level being 26, generated by the dither matrix shown in FIGS. 31 and 32 are the data shown in the upper column "HALF-TONED TONE DATA" in FIG. 33. That is, the pattern data are generated so that the spot exposes the whole area of the single pixel, as for the pixel corresponding to the threshold level A, and that the left-aligning of 1/16 pixel is executed, as for the pixel corresponding to the threshold level B. At this point, a square of heavy line indicates a cell, a square of thin line indicates a pixel, and a shaded area indicates an area exposed by the spot in FIG. 33. And, in the first example, the video signal composed of pulses whose pulse widths correspond to the exposing area as shown in the lower column "VIDEO SIGNAL" in FIG. 33 is inputted to the exposure controller 102 directly. And, the light beam is emitted from the laser source 62 modulated by the video signal, whereby the patch latent image PL is formed at the position described next.

Figure 34:
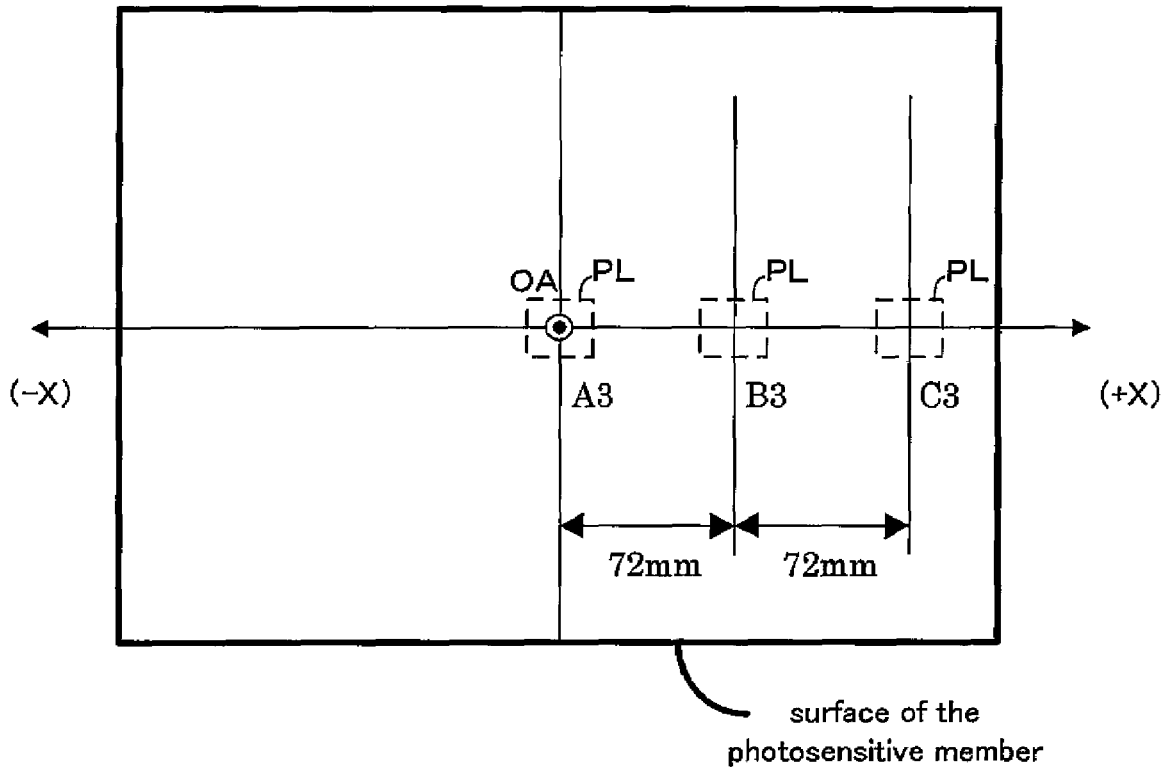
FIG. 34 is a drawing which shows the patch latent image formation step in the first example.

FIG. 34 is a drawing which shows the patch latent image formation step in the first example. In the first example, patch latent images PL are formed at the positions represented by the reference characters A3, B3 and C3 in FIG. 34 respectively, based upon the halftone data which are obtained by the execution of the halftone processing and which correspond to the highlight image of the density of 10%, that is the tone level being 26. At this point, the position represented by the reference character A3 is on the optical axis OA, and the position represented by the reference character B3 is at 72 mm away from the optical axis OA in the first direction (+X) of the main scanning direction X, and the position represented by the reference character C3 is at 72 mm further away from the position represented by the reference character B3 in the same direction. And, the patch development step is executed to the patch latent images PL which are formed in this way and which correspond to the highlight image of the density 10%, that is the tone level being 26, to form the highlight images PV on the surface of the photosensitive member 2, and the primary transfer and the secondary transfer are executed to transfer the highlight images PV onto the surface of the sheet S.

Next, the density detection step is executed and the density of the three highlight images formed on the sheet S are measured, and the result is shown in Table 1. As can be understood from the Table 1, the density of the highlight image formed on the optical axis OA is the highest and the density decreases with the distance from the optical axis OA in the main scanning direction X. So, the pattern generation step is executed based upon the result shown in Table 1 and the optimum conversion pattern and predetermined tone range of the invention are obtained.

TABLE 1

| position of an image | density of an image |
|---|---|
| A | 0.18 |
| B | 0.16 |
| C | 0.14 |

Figure 35:
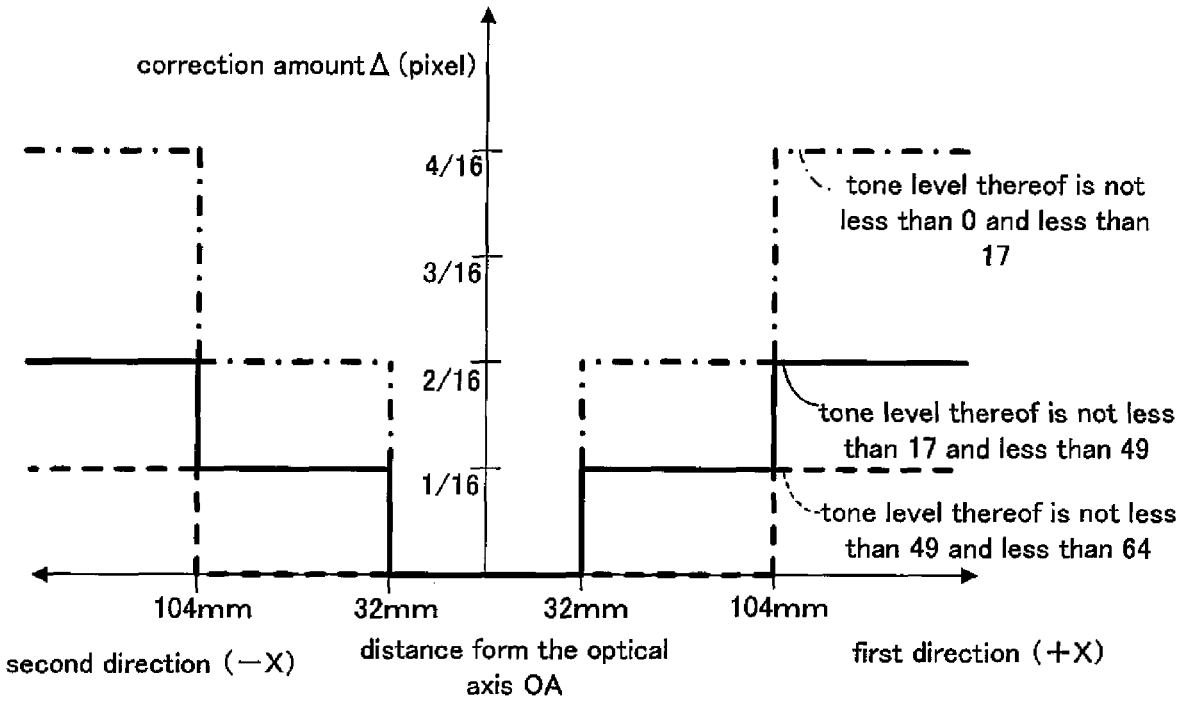
FIG. 35 is a drawing which shows the conversion pattern obtained in the pattern generation step in the first example.

FIG. 35 is a drawing which shows the conversion pattern obtained in the pattern generation step in the first example. In FIG. 35, the axis of abscissas represents a distance between the cell corresponding to the pulse and the optical axis OA of the scanning optical system, and the axis of ordinates represents the correction amount. Further, as shown in FIG. 35, the conversion pattern obtained in the pattern generation step is composed of three correction amount curves which increase the correction amount Δ in a stepwise fashion as the distance between the cell and the optical axis OA of the scanning optical system increases. Further, the predetermined tone range is set not less than the tone level of 0 and less than that of 64. And, the corrected video signal is generated using the correction amount curve represented by the dashed line when the tone level of the cell corresponding to the pulse is not less than 49 and less than 64, the correction amount curve represented by the solid line when the tone level thereof is not less than 17 and less than 49, and the correction amount curve represented by the dashed-dotted line when the tone level thereof is not less than 0 and less than 17. That is, the conversion pattern is obtained so that the lower the tone level of the cell corresponding to the pulse is, the larger the correction amount becomes.

Figure 36:
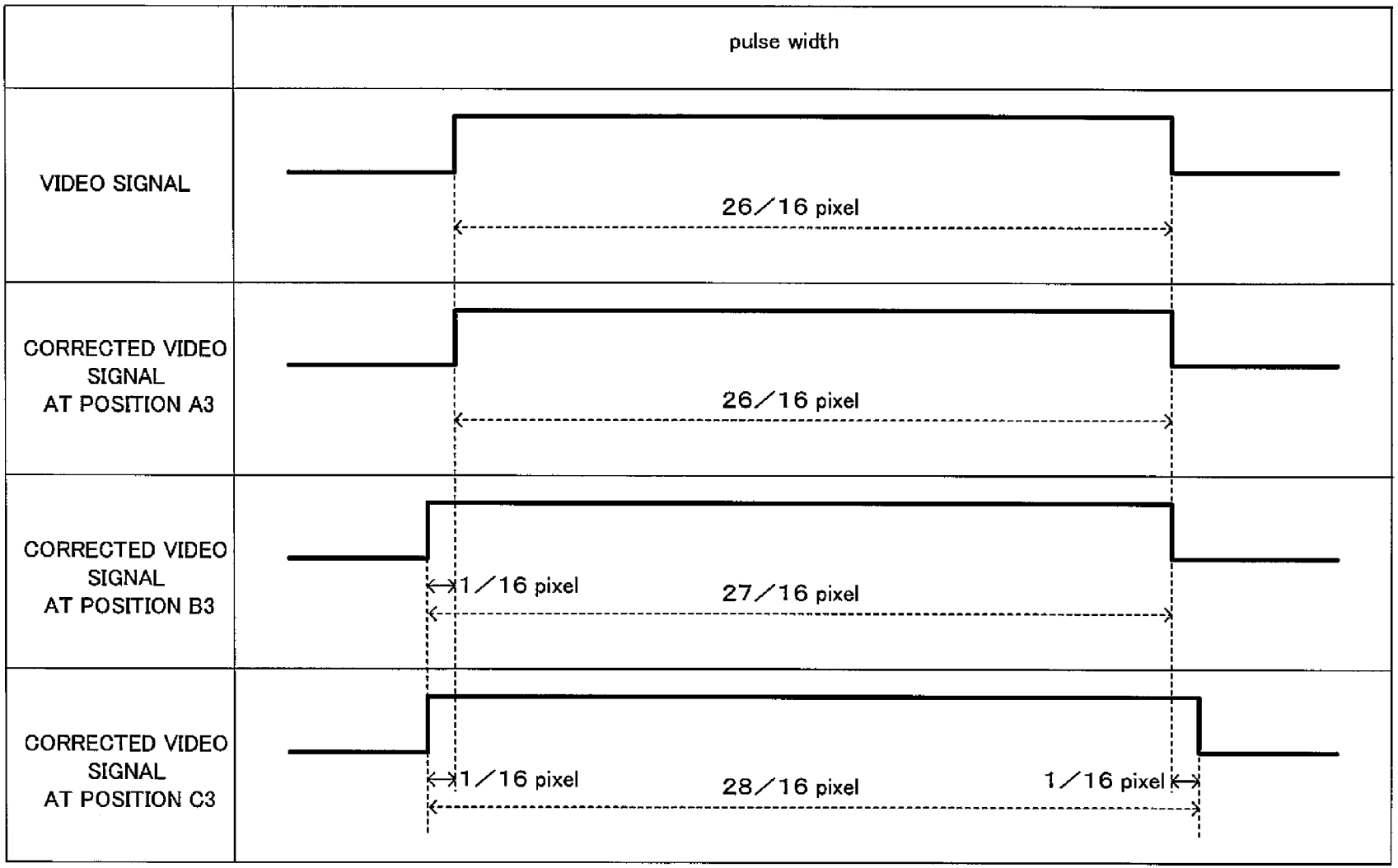
FIG. 36 is a group of drawings which show the corrected video signals in forming the patch latent images at the respective positions.

Consequently, in order to confirm the effect of the invention, the exposing signal correction step is executed to the video signal shown in FIG. 33 based upon the predetermined tone range and the conversion pattern which are obtained in the pattern generation step to generate the corrected video signal, and the patch latent images PL are formed at the same positions as shown in FIG. 34, that is, the positions represented by the reference characters A3, B3, and C3. FIG. 36 is a group of drawings which show the corrected video signals to form the patch latent images PL at the respective positions. Meanwhile, since the tone level is 26, the conversion pattern used is the correction amount curve represented by the solid line in FIG. 35. The patch latent image PL formed at the position represented by the reference character A3 is formed on the optical axis OA as described above with reference to FIG. 34. Hence, using the correction amount curve represented by the solid line as the conversion pattern shown in FIG. 35, the pulse width of the corrected video signal is 26/16 pixel, the same as the pulse width of the video signal as shown in the column "CORRECTED VIDEO SIGNAL AT POSITION A3" in FIG. 36. Further, the patch latent image PL formed at the position represented by the reference character B3 is formed at 72 mm away from the optical axis OA in the main scanning direction X as described above with reference to FIG. 34. Hence, using the correction amount curve represented by the solid line as the conversion pattern shown in FIG. 35, the pulse width of the corrected video signal is 27/16 pixel, larger than the pulse width of the video signal by 1/16 pixel as shown in the column "CORRECTED VIDEO SIGNAL AT POSITION B3" in FIG. 36. Further, the patch latent image PL formed at the position represented by the reference character C3 is formed at 144 mm, equal to 72 mm+72 mm, away from the optical axis OA in the main scanning direction X as described above with reference to FIG. 34. Hence, using the correction amount curve represented by the solid line as the conversion pattern shown in FIG. 35, the pulse width of the corrected video signal is 28/16 pixel, larger than the pulse width of the video signal by 2/16 pixel as shown in the column "CORRECTED VIDEO SIGNAL AT POSITION C3" in FIG. 36. Then, the patch latent images formed based upon such corrected video signals are developed and transferred onto the sheet S, and the density of the patch images are measured. Table 2 shows the result. As can be understood from Table 2, the density difference in the main scanning direction X is reduced compared to the result shown in Table 1 and a good image formation is realized, by forming the highlight image based upon the conversion pattern obtained as shown in FIG. 35.

TABLE 2

| position of an image | density of an image |
|---|---|
| A | 0.18 |
| B | 0.18 |
| C | 0.18 |

Second Example

In the second example, a comparison is made between the case where the patch images are formed at the end part under the same condition as the simulation shown in FIG. 29A and the case where the patch images are formed at the end part under the same condition as the simulation shown in FIG. 30A. Meanwhile, image data of the density of 10% are generated using WORD of Microsoft Corporation and the image is formed based upon the image data, whereby the patch images in this example are formed.

Table 3 shows a measured result of the density of the patch image formed at the central part under the same condition as the simulation shown in FIG. 28A and the patch image formed at the end part under the same condition as the simulation shown in FIG. 29A. That is, the patch image at the central part and the patch image at the end part in Table 3 are formed under the same condition as for the light quantity of the light beam emitted from the light source and as for the pulse width of the pulse to drive the light source. In this case, the density difference of 0.04 is developed between the patch image formed at the central part and the patch image formed at the end part as can be understood from Table 3.

So, the patch image is formed at the end part under the same condition as the simulation shown in FIG. 30A and the densities of the patch image formed at the end part and the patch image formed at the central part are measured again respectively. Table 4 shows the remeasurement result. In this case, there is no density difference between the patch image formed at the central part and the patch image formed at the end part as shown in Table 4. Thus, the condition to form the patch image at the end part is changed to the condition in the simulation shown in FIG. 30A, whereby the density difference between the patch image formed at the central part and the patch image formed at the end part is reduced.

TABLE 3

| position of an image | density of an image |
|---|---|
| central part | 0.18 |
| end part | 0.14 |

TABLE 4

| position of an image | density of an image |
|---|---|
| central part | 0.18 |
| end part | 0.18 |

Although the invention has been described with reference to specific embodiments, this description is not meant to be construed in a limiting sense. Various modifications of the disclosed embodiment, as well as other embodiments of the invention, will become apparent to persons skilled in the art upon reference to the description of the invention. It is therefore contemplated that the appended claims will cover any such modifications or embodiments as fall within the true scope of the invention.

What is claimed is:

1. A method for controlling an optical scanning apparatus comprising:

generating an exposing signal from a pattern data for an optical scanning apparatus, which includes a light source that emits a light beam, a deflector that deflects the light beam emitted from the light source by means of a deflection mirror surface oscillating sinusoidally, and a scanning optical system that has an arcsine characteristics and that images the light beam deflected by the deflector on a surface-to-be-scanned in a spot, and which makes the imaged spot scan the surface-to-be-scanned in the main scanning direction while modulating the light beam emitted from the light source based upon the pattern data indicating a position on the surface-to-be-scanned the light beam exposes so that the light beam exposes a predetermined position on the surface-to-be-scanned, the exposing signal being a train of pulses arranged on a time axis in accordance with an arrangement in the main scanning direction of values, which the pattern data have, indicating exposure or non-exposure of the light beam, a pulse width of each pulse of the pulses being width of time corresponding to a length, indicated by the pattern data, in the main scanning direction of an exposing area of the light beam;

correcting the exposing signal to generate a corrected exposing signal by varying pulse width of each pulse of the pulses which compose the exposing signal in accordance with a distance between the exposing area corresponding to the pulse and an optical axis of the scanning optical system;

emitting the light beam from the light source modulated by the corrected exposing signal; and executing a halftone processing in which arranging hypothetically a plurality of cells composed of plural pixels adjoining each other on the surface-to-be-scanned, and comparing an image tone data, which indicate position and a tone level of each of the plural pixels, with a dither matrix for each cell, thereby generating the pattern data that indicate a position in the cell for the light beam to expose in a spot-like fashion, wherein the pulse width of each pulse/both of the pulse width of each pulse and light quantity of the light beam is/are varied in accordance with a distance between the exposing area and an optical axis of the scanning optical system, and in correcting the exposing signal to generate the corrected exposing signal, pulse width of each pulse of the pulses which compose the exposing signal is converted based upon a conversion pattern that increases the pulse width in accordance with a distance in the main scanning direction between the exposing area corresponding to the pulse and the optical axis of the scanning optical system.

2. The method for controlling an optical scanning apparatus of claim 1, wherein the conversion pattern also increases the pulse width as the tone level of the cell, to which the exposing area corresponding the pulse belongs, decreases.

3. The method for controlling an optical scanning apparatus of claim 1, wherein the halftone processing is executed using the same dither matrix for all the cells.

4. The method for controlling an optical scanning apparatus of claim 1, further comprising:

forming a plurality of electrostatic latent images on the surface-to-be-scanned at positions different from each other in the main scanning direction respectively by means of the optical scanning apparatus;

forming the plurality of toner images by developing the plurality of electrostatic latent images with toner;

detecting densities of the plurality of toner images respectively; and generating the conversion pattern based, on the detection result in detecting densities thereof.

5. The method for controlling an optical scanning apparatus of claim 4, wherein one of the plurality of electrostatic latent images is formed on the optical axis of the scanning optical system.

6. The method for controlling an optical scanning apparatus of claim 4, wherein forming two electrostatic latent images as the plurality of electrostatic latent images at positions asymmetric to each other relative to the optical axis of the scanning optical system in the main scanning direction.

7. The method for controlling an optical scanning apparatus of claim 6, wherein one of the two electrostatic latent images is formed on the optical axis of the scanning optical system.

8. A method for controlling an optical scanning apparatus comprising:

generating an exposing signal from a pattern data for an optical scanning apparatus, which includes a light source that emits a light beam, a deflector that deflects the light beam emitted from the light source by means of a deflection mirror surface oscillating sinusoidally, and a scanning optical system that has an arcsine characteristics and that images the light beam deflected by the deflector on a surface-to-be-scanned in a spot, and which makes the imaged spot scan the surface-to-be-scanned in the main scanning direction while modulating the light beam emitted from the light source based upon the pattern data indicating a position on the surface-to-be-scanned the light beam exposes so that the light beam exposes a predetermined position on the surface-to-be-scanned, the exposing signal being a train of pulses arranged on a time axis in accordance with an arrangement in the main scanning direction of values, which the pattern data have, indicating exposure or non-exposure of the light beam, a pulse width of each pulse of the pulses being width of time corresponding to a length, indicated by the pattern data, in the main scanning direction of an exposing area of the light beam;

correcting the exposing signal to generate a corrected exposing signal by varying pulse width of each pulse of the pulses which compose the exposing signal in accordance with a distance between the exposing area corresponding to the pulse and an optical axis of the scanning optical system; and emitting the light beam from the light source modulated by the corrected exposing signal, wherein the pulse width of each pulse/both of the pulse width of each pulse and light quantity of the light beam is/are varied in accordance with a distance between the exposing area and an optical axis of the scanning optical system, in correcting the exposing signal to generate the corrected exposing signal, pulse width of each pulse of the pulses which compose the exposing signal is converted based upon a conversion pattern that decreases the pulse width in accordance with a distance in the main scanning direction between the exposing area corresponding to the pulse and the optical axis of the scanning optical system, and in emitting the light beam from the light source, the light beam is modulated by the corrected exposing signal, while controlling the light quantity of the light beam emitted from the light source based upon a light quantity pattern that increases the light quantity of the light beam in accordance with a distance in the main scanning direction between the exposing area exposed by the light beam emitted from the light source and the optical axis of the scanning optical system.

9. The method for controlling an optical scanning apparatus of claim 8, wherein the light quantity pattern is a pattern that increases the light quantity of the light beam in accordance with the distance in the main scanning direction between the exposing area exposed by the light beam emitted from the light source and the optical axis of the scanning optical system so that the peak value of the light quantity of the spot is constant regardless of the position of the spot in the main scanning direction.

10. The method for controlling an optical scanning apparatus of claim 8, further comprising:

forming a plurality of electrostatic latent images on the surface-to-be-scanned at positions different from each other in the main scanning direction respectively by means of the optical scanning apparatus;

forming the plurality of toner images by developing the plurality of electrostatic latent images with toner;

detecting densities of the plurality of toner images respectively; and generating the conversion pattern based upon the detection result in detecting densities thereof.

11. The method for controlling an optical scanning apparatus of claim 10, wherein one of the plurality of electrostatic latent images is formed on the optical axis of the scanning optical system.

12. The method for controlling an optical scanning apparatus of claim 10, wherein forming two electrostatic latent images as the plurality of electrostatic latent images at positions asymmetric to each other relative to the optical axis of the scanning optical system in the main scanning direction.

13. The method for controlling an optical scanning apparatus of claim 8, further comprising:

forming a plurality of electrostatic latent images on the surface-to-be-scanned at positions different from each other in the main scanning direction respectively by means of the optical scanning apparatus;

forming the plurality of toner images by developing the plurality of electrostatic latent images with toner;

detecting densities of the plurality of toner images respectively; and generating the conversion pattern and the light quantity pattern based upon the detection result in detecting densities thereof.

* * * * *